US012760464B2

(12) United States Patent
Choe et al.

(10) Patent No.: US 12,760,464 B2
(45) Date of Patent: Oct. 13, 2026

(54) LAUNDRY TREATING APPARATUS

(71) Applicant: LG Electronics Inc., Seoul (KR)

(72) Inventors: Dami Choe, Seoul (KR); Soyeon Ko, Seoul (KR); Jungchul Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 255 days.

(21) Appl. No.: 18/574,961

(22) PCT Filed: Jun. 14, 2022

(86) PCT No.: PCT/KR2022/008340
§ 371 (c)(1),
(2) Date: Dec. 28, 2023

(87) PCT Pub. No.: WO2023/277394
PCT Pub. Date: Jan. 5, 2023

(65) Prior Publication Data

US 2024/0352641 A1 Oct. 24, 2024

(30) Foreign Application Priority Data

Jun. 28, 2021 (KR) ..... 10-2021-0084036

(51) Int. Cl.
*D06F 34/30* (2020.01)
*D06F 34/32* (2020.01)
*D06F 34/34* (2020.01)

(52) U.S. Cl.
CPC ..... *D06F 34/30* (2020.02); *D06F 34/32* (2020.02); *D06F 34/34* (2020.02)

(58) Field of Classification Search
None
See application file for complete search history.

(56) References Cited

U.S. PATENT DOCUMENTS 10,550,506 B2 * 2/2020 Oh ..... D06F 34/28
2003/0025733 A1 2/2003 Broker et al.
(Continued)

FOREIGN PATENT DOCUMENTS

CA 2393316 A1 2/2003
CN 109881444 A † 6/2019
(Continued)

OTHER PUBLICATIONS

Google Patents Search History (Year: 2026).*
(Continued)

*Primary Examiner* — Rita P Adhlakha
(74) *Attorney, Agent, or Firm* — Fish & Richardson P.C.

(57) ABSTRACT

Disclosed is a laundry treating apparatus, and the laundry treating apparatus according to an embodiment of the present disclosure comprises: a cabinet; a drum which is provided within the cabinet, is rotatably provided, and accommodates laundry therein; a control part provided to store a plurality of courses for treating laundry, and control rotation of the drum to perform the plurality of courses; an option button part which is provided in the cabinet, and is manipulated by a user to adjust an option setting value for each of the plurality of courses; and a screen output part which is provided in the cabinet and outputs a screen for providing information to the user, wherein the screen output part is provided to output a course selection screen on which any of the plurality of courses for treating laundry is displayed, and when the option button part is manipulated, the course selection screen is converted into an option screen.

19 Claims, 20 Drawing Sheets

(56) References Cited

U.S. PATENT DOCUMENTS

| | | | | |
|---|---|---|---|---|
| 2009/0320530 | A1 | 12/2009 | Kim et al. | |
| 2012/0110749 | A1 * | 5/2012 | Park | D06F 33/00 8/137 |
| 2013/0290902 | A1 | 10/2013 | Martin et al. | |
| 2016/0201248 | A1 † | 7/2016 | Kim | |
| 2017/0321366 | A1 † | 11/2017 | Oh | |
| 2019/0194857 | A1 | 6/2019 | De Luca et al. | |
| 2021/0164145 | A1 | 6/2021 | Kim et al. | |

FOREIGN PATENT DOCUMENTS

| | | | |
|---|---|---|---|
| DE | 10035642 | C1 | 12/2001 |
| EP | 2765488 | A2 | 8/2014 |
| EP | 3225731 | A1 | 10/2017 |
| KR | 10-2007-0070781 | | 7/2007 |
| KR | 10-2014-0103763 | A | 8/2014 |
| KR | 10-2016-0062917 | | 6/2016 |
| KR | 10-2016-0062918 | | 6/2016 |
| KR | 10-1637350 | | 7/2016 |
| KR | 10-2019-0016363 | | 2/2019 |

OTHER PUBLICATIONS

Extended European Search Report in European Appln. No. 22833450.4, mailed on Jun. 2, 2025, 9 pages.
Office Action in Australian Appln. No. 2022302637, mailed on May 13, 2025, 6 pages.
International Search Report and Written Opinion in International Appln. No. PCT/KR2022/008340, mailed on Oct. 7, 2022, 13 pages (with English translation).

* cited by examiner
† cited by third party

FIG. 22

| Option Combination / Course | First Option Combination | Second Option Combination | Third Option Combination | Fourth Option Combination | Fifth Option Combination |
|---|---|---|---|---|---|
| First Course | · | | · | · | · |
| Second Course | | | | | |
| Third Course | | · | · | | · |
| Fourth Course | | | · | | · |
| Fifth Course | | | · | · | · |
| Sixth Course | | | | | |

LAUNDRY TREATING APPARATUS

TECHNICAL FIELD

The present disclosure relates to a laundry treatment apparatus, and more particularly, to a laundry treatment apparatus including a screen output unit configured to output a screen and a manipulator manipulated by a user.

BACKGROUND

An electronic device including a laundry treatment apparatus for laundry of clothing (commonly known as a laundry object or drying object), drying of clothing, and laundry and drying of clothing requires an input and output device (interface) for a user to input a control command to the electronic device.

Among existing interfaces, a display for displaying a control command to be selected by a user, a search unit for searching for the control command displayed on the display, a selection unit for allowing the user to select the control command displayed on the display, and an input unit for requesting execution of the control command selected by the user are designed to be positioned in separated spaces (Korean Publication No. 10-2014-0023986).

That is, with regard to the existing interface, a display (LCD or LED panel) for displaying a control command, a knob button for searching for a control command to be executed by a corresponding electronic device by displaying the control command on the display, a button for selecting the control command displayed on the display, a button for inputting a control command for requesting execution of the selected control command are arranged in separate spaces, respectively, and such arrangement is a factor that determines a design (design of a control panel) of an interface positioned on a front surface of an electronic device such as a laundry treatment apparatus.

With regard to the existing interface with the aforementioned configuration, devices including a display are distributed in a width direction of an electronic device or distributed in a height direction of the electronic device, and thus there is a need for many spaces to install the interface.

Accordingly, it is important to efficiently arrange a screen output unit, a manipulator, an option unit, and the like constituting an interface, thereby improving use convenience and improving spatial utilization through efficient arrangement.

The related document KR 10-2016-0062917 discloses a laundry treatment apparatus including a screen output unit. The laundry treatment apparatus includes a rotatable knob around the screen output unit.

In the laundry treatment apparatus, the user may select various selection items displayed in the screen output unit through rotation of the knob, and a plurality of buttons such as a start button of a course or a power button for treating clothes may be additionally provided on the screen output unit.

The laundry treatment apparatus includes a plurality of buttons on the screen output unit, and thus a screen area provided within an inner space defined by the knob may be reduced, and the intuitiveness of the user with respect to each button may be degraded.

Due to the limited output area, it may be disadvantageous to display various information on the display of the screen output unit, which has a limited area due to the knob and the plurality of buttons.

Accordingly, it is important in the art that various buttons constituting the manipulator are efficiently configured to effectively increase the screen area of the screen output unit, and various information is effectively provided to the user in the limited screen area.

The laundry treatment apparatus may include various courses, such as a washing course, a drying course, and a spin-dry course of clothes, and various options for the course may be adjusted by a user.

However, even if the option is adjusted, it may be difficult for the user to intuitively check whether the current option setting value is changed to any value, and it may be difficult to check various options.

Accordingly, it may be important for the user to conveniently check the option setting value and to check and conveniently adjust the option setting value through the screen output unit at the same time.

DETAILED DESCRIPTION

An object of the present disclosure is to provide a laundry treatment apparatus including a screen output unit configured to effectively provide various information to a user during a clothing treatment process and a manipulator configured to conveniently input a manipulation signal by the user.

An object of the present disclosure is to provide a laundry treatment apparatus in which an installation area for installing a screen output unit configured to output a screen and a manipulator configured to generate a manipulation signal is effectively configured in a limited area.

An object of the present disclosure is to provide a laundry treatment apparatus including a manipulator for efficiently generating various manipulation signals required for a user to perform a laundry treatment process and for effectively reducing an installation space.

An object of the present disclosure is to provide a laundry treatment apparatus for effectively displaying various information in a limited screen area to effectively improve use convenience and improve space utilization.

An object of the present disclosure is to provide a laundry treatment apparatus that allows a user to conveniently check each option change for a plurality of courses for treating clothes and effectively adjust an option setting value of the option.

Technical Solution

An embodiment of the present disclosure, a screen output unit configured to output a screen for providing information to a user may be provided and may output an option screen on which an option value is displayed in a situation in which a setting value of an option is changed.

The option value for the option in which the user changes the option setting value may be displayed on the option screen, and the user may set any one of the plurality of option values as the option setting value on the option screen.

The option screen may be provided differently for each option. For example, the option screen may include a first option screen corresponding to a first option and a second option screen corresponding to a second option. Accordingly, in an embodiment of the present disclosure, a plurality of option information may be effectively transmitted to the user even in a limited display area.

A laundry treatment apparatus according to an embodiment of the present disclosure includes a cabinet, a drum, a controller, an option button unit, and a screen output unit. The drum may be provided in the cabinet, provided to be rotatable, and accommodating clothes therein.

The controller may be provided to store a plurality of courses for treating clothes and control rotation of the drum to perform the plurality of courses. The option button unit may be provided in the cabinet and may be manipulated by the user to adjust an option setting value for each of the plurality of courses.

The screen output unit may be provided in the cabinet and output a screen for providing information to a user. The screen output unit is provided to output a course selection screen on which any one of a plurality of courses for treating clothes is displayed, is converted into an option screen when the option button unit is manipulated on the course selection screen, and a plurality of option values for the course displayed on the course selection screen are displayed on the option screen.

The screen output unit may be switched from the course selection screen to the option screen in the entire display area where the screen is output. The screen output unit may be switched from the course selection screen to the option screen through a pop-up method.

The option button unit may include a first option button unit for adjusting a first option and a second option button unit for adjusting a second option, and the screen output unit may be switched to a first option screen in which an option value of the first option is displayed when the first option button unit is manipulated on the course selection screen, and the second option button unit may be switched to a second option screen on which an option value of the second option is displayed when the second option button unit is operated.

The option button unit may be provided in a plural number to adjust different options, the controller may store a plurality of option values for each of a plurality of options, any one of the plurality of option values may be set as an option setting value of the corresponding option, and the course selection screen may include an option guide area in which an option setting value of the currently displayed course is displayed, and the option screen may include an option value display area in which at least some of the option setting value of the corresponding option and the plurality of option values are displayed together.

The screen output unit may display one of the plurality of option values as an option setting value on the option screen, and when the option button unit is manipulated, the other one of the plurality of option values may be displayed as an option setting value.

The screen output unit may be displayed by sequentially arranging at least some of the plurality of option values on the option screen, and when the option button unit is manipulated, an option value corresponding to a next order of the current option setting value may be changed to an option setting value and displayed.

When the option button unit is manipulated on the option screen, the screen output unit may display the plurality of option values as moving motions, and the remaining areas except for the plurality of option values may remain the same.

The option screen may include an option setting value display area in which a current option setting value is displayed, and may further include a previous order display area positioned at one side of the option setting value display area and displaying a previous order option value of the current option setting value, and a next order display area positioned at the other side of the option setting value display area to display a next order option value of the current option setting value.

When the option button unit is manipulated on the option screen, the screen output unit may be displayed by moving the option value of the option setting value display area to the previous order display area, and the option value of the next order display area may be moved to the option setting value display area to be displayed.

The screen output unit may further include a dial unit configured to be rotatable while surrounding the screen output unit, wherein, when the dial unit rotates in one direction on the option screen, the screen output unit may be displayed by moving an option value of the option setting value display area to the previous order display area, and when the dial unit rotates in the other direction, the option value of the option setting value display area may be moved to the next order display area and displayed.

The screen output unit may return to the course selection screen from the option screen when a manipulation signal of the option button unit is not generated during a preset option setting time in the controller on the option screen.

The controller may store a plurality of option values for the option adjusted by the option button unit, and any one of the plurality of option values may be set as an option setting value.

The washing machine may further include an option unit including the option button unit, wherein the option unit further includes an option display unit on which the option setting value is displayed, and the screen output unit may display the option setting value together with the option display unit on the option screen.

The option display unit may include a plurality of light emitting units, the plurality of light emitting units may correspond to different option values for the option, and a light emitting unit corresponding to a currently set option setting value may emit light.

The plurality of light emitting units may be arranged in parallel with each other from the option button unit in one direction. The option unit may include an option adjuster including the option display unit and the option button unit, and the option adjuster may be provided in a plural number, provided to correspond to different options, and provided to emit light, and the controller may set adjustable options among a plurality of options with respect to each of the plurality of courses.

Each of the plurality of option adjusters may be configured to emit light when each of the plurality of option adjusters corresponds to an adjustable option in the course currently displayed on the course selection screen to guide the user to adjust the option.

Advantageous Effects

Embodiments of the present disclosure may provide a laundry treatment apparatus including a screen output unit configured to effectively provide various information to a user during a clothing treatment process and a manipulator configured to conveniently input a manipulation signal by the user.

Embodiments of the present disclosure may provide a laundry treatment apparatus in which an installation area for installing a screen output unit configured to output a screen and a manipulator configured to generate a manipulation signal is effectively configured in a limited area.

Embodiments of the present disclosure may provide a laundry treatment apparatus including a manipulator for efficiently generating various manipulation signals required for a user to perform a laundry treatment process and for effectively reducing an installation space.

Embodiments of the present disclosure may provide a laundry treatment apparatus for effectively displaying various information in a limited screen area to effectively improve use convenience and improve space utilization.

Embodiments of the present disclosure may provide a laundry treatment apparatus that allows a user to conveniently edit a plurality of courses for treating clothes, thereby effectively improving user convenience.

BRIEF DESCRIPTION OF THE DRAWINGS

FIG. 22 is a table showing application of each of a plurality of option combinations for a plurality of courses in an embodiment of the present disclosure.

BEST MODE

Figure 1:
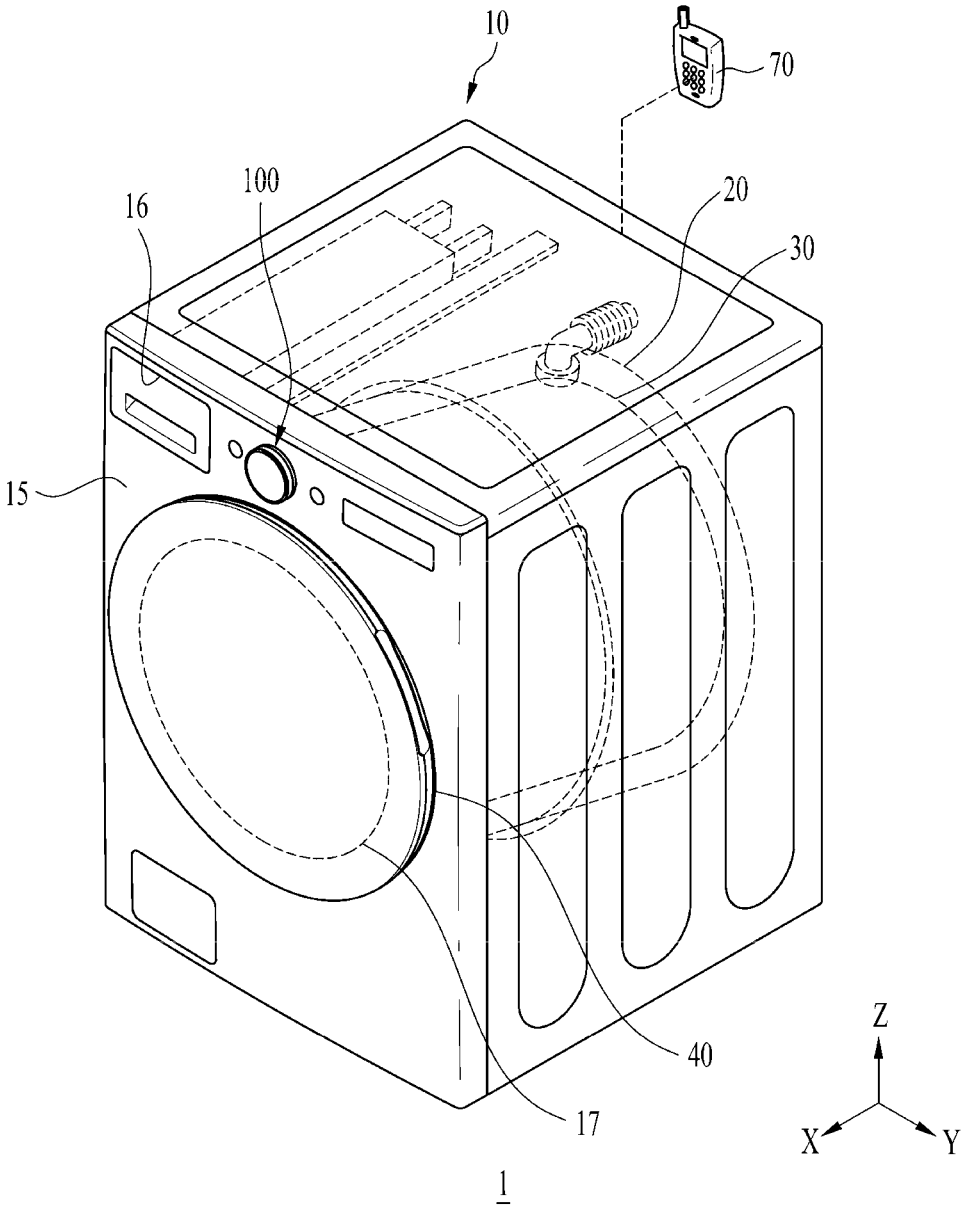
FIG. 1 is a diagram illustrating a laundry treatment apparatus according to an embodiment of the present disclosure.

Exemplary embodiments of the present disclosure are described in detail so as for those of ordinary skill in the art to easily implement with reference to the accompanying drawings.

However, the present disclosure may be implemented in various different forms and is not limited to these embodiments. To clearly describe the present disclosure, a part without concerning to the description is omitted in the drawings, and like reference numerals in the specification denote like elements.

In the present specification, repeated descriptions of the same constituent elements will be omitted.

In the present specification, it will be understood that when an element is referred to as being "connected to" or "coupled to" another element, it may be directly on, connected or coupled to the other element or intervening elements may be present. In contrast, in the present specification, when an element is referred to as being "directly on," "directly connected to" or "directly coupled to" another element or layer, there are no intervening elements or layers present.

In the present specification, the terms are used to describe specific embodiments only, and are not intended to limit the present disclosure.

In the present specification, the singular expression may include a plurality of expressions unless the context clearly indicates otherwise.

It will be further understood that the terms "comprises" and/or "comprising," when used herein, specify the presence of stated features, integers, steps, operations, elements, and/or components, but do not preclude the presence or addition of one or more other features, integers, steps, operations, elements, components, and/or combinations thereof.

As used herein, the term "and/or" includes a combination of a plurality of items or any one of a plurality of listed items. In the present specification, 'A or B' may include 'A', 'B', or 'both A and B'.

FIG. 1 illustrates an outer appearance of a laundry treatment apparatus 1 according to an embodiment of the present disclosure. As shown in FIG. 1, in an embodiment of the present disclosure, the laundry treatment apparatus 1 may include a cabinet 10.

The cabinet 10 may define the outer appearance of the laundry treatment apparatus 1, and a space in which a drum 30 and a tub 20 are provided may be formed in the cabinet 10. Although a hexahedral cabinet 10 is illustrated in FIG. 1, a specific shape of the cabinet 10 may vary.

The cabinet 10 may include a plurality of panels. The plurality of panels may include a front panel 15, a side panel, an upper panel, a lower panel, and a rear panel. The plurality of panels may be coupled to each other to form the cabinet 10 together.

A detergent opening 16 and a laundry opening 17 may be formed in a front panel 15. The detergent opening 16 may correspond to a passage through which a storage unit of a detergent supply device moves, and the laundry opening 17 may correspond to a passage through which the user inputs clothes to the drum 30 inside the cabinet 10.

That is, in an embodiment of the present disclosure, the cabinet 10 includes the front panel 15 having the detergent opening 16 formed therein.

The front panel 15 may include a laundry door 40 configured to open and close the laundry opening 17, and the laundry door 40 may be pivotably hinged to the outside of the front panel 15. The laundry opening 17 of the front panel 15 may be opened or closed by the laundry door 40.

The tub 20 may be provided inside the cabinet 10 and may accommodate water therein, and the drum 30 may be rotatably provided in the tub 20 and may accommodate clothes therein.

In an embodiment of the present disclosure, the drum 30 may have outer circumferential surface including a plurality of communication holes are formed therein, through which the tub 20 and the inside communicate with each other, and thus water stored in the tub 20 may be provided to the inside of the drum 30 to be provided to clothes.

As shown in FIG. 1, the laundry treatment apparatus according to an embodiment of the present disclosure may include both the drum 30 and the tub 20, or may include only the drum 30 except for the tub 20 as necessary. That is, an embodiment of the present disclosure may correspond to a washing machine for performing a washing course for treating clothes by including the drum 30 and a tub 20 in which water is accommodated or correspond to a dryer for performing a drying course for drying clothes inside the drum 30 by omitting the tub 20 and including only the drum 30.

However, an embodiment of the present disclosure may correspond to the laundry treatment apparatus 1 including both the drum 30 and the tub 20 and including an air supply unit for drying clothes to perform both the washing course and the drying course. Hereinafter, unless otherwise stated, the present disclosure will be described in terms of a form in which the drum 30 and the tub 20 are provided together in the cabinet 10 will be described according to an embodiment of the present disclosure.

The laundry treatment apparatus 1 according to an embodiment of the present disclosure may include a detergent supply device for performing the washing course. The detergent supply device is a device provided inside the cabinet 10 or provided outside the cabinet 10 to supply detergent into the tub 20 or the drum 30.

In the present disclosure, the detergent includes not only a washing agent for removing foreign substances of clothes, a softener for improving the flexibility of a fiber, and a bleaching agent for improving the color of the fiber. The detergent may be defined to include various types and types of detergent such as a powdered detergent or a liquid detergent.

The detergent supply device may include a storage unit in which detergent is stored, and the storage unit may be retracted or extended into or out of the cabinet 10 through the detergent opening 16 of the front panel 15.

The laundry treatment apparatus 1 according an embodiment of the present disclosure may include a control panel 100 including a screen output unit 8 configured to output a screen and a manipulator manipulated by the user to generate a manipulation signal.

FIG. 1 illustrates a state in which the control panel 100 is provided on the front panel 15 according to an embodiment of the present disclosure. However, the control panel 100 may be provided not only on the front panel 15, but also on a top panel or a side panel, or may be provided in each of a plurality of panels.

Referring to FIG. 1, in an embodiment of the present disclosure, the control panel 100 may be provided at an upper end portion of the front panel 15. The upper end portion of the front panel 15 may be understood as a portion including an upper end of the front panel 15 and the control panel 100.

The control panel 100 may be manufactured separately from the front panel 15 and coupled to the front panel 15, or a part of the front panel 15 may correspond to the control panel 100. When the control panel 100 is manufactured separately from the front panel 15, the control panel 100 may be provided on the front panel 15 to form a front surface of the cabinet 10 together with the front panel 15.

The control panel 100 may include a manipulator, and the manipulator may include a button manipulated by the user. The manipulator may be manipulated by the user to generate a manipulation signal, and the manipulation signal may be transmitted to a controller 60 to be described below.

In the present disclosure, the manipulator may collectively refer to an object that is manipulated by the user to generate a manipulation signal and may include a dial unit 56, a multi-function button unit 91, an option button unit, and an additional option button unit. The manipulator will be described in detail below.

The control panel 100 may include the screen output unit 8, and the screen output unit 8 may include a display 84 configured to output a screen for providing information to the user. The screen output unit 8 will be described in detail below with the manipulator.

The laundry treatment apparatus 1 according an embodiment of the present disclosure may include a controller 60, and the controller 60 may be electrically and signally connected to the manipulator. The controller 60 may be electrically and signally connected to an object that needs to be electrically/electronically controlled, such as a driver for rotating the drum 30 or a water supply unit for supplying water.

The controller 60 may receive a signal input to the manipulator by the user and control each component of the laundry treatment apparatus 1 based on the transmitted signal. An operation state of the laundry treatment apparatus 1 may be transmitted to the user through the manipulator based on the signal transmitted from each of the components.

Figure 2:
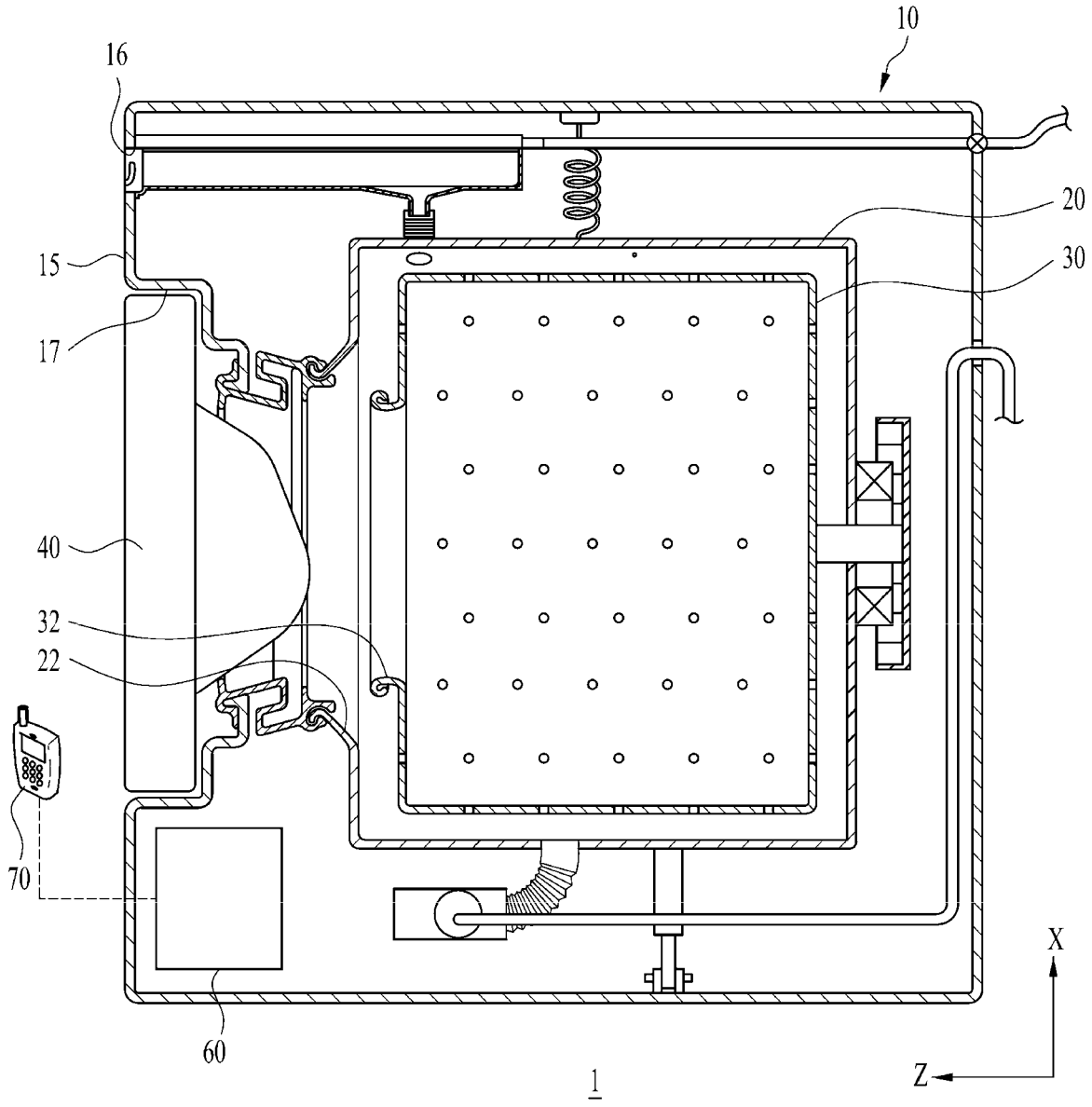
FIG. 2 is a diagram illustrating an inner cross-section of a laundry treatment apparatus according to an embodiment of the present disclosure.

FIG. 2 is a diagram illustrating an inner cross-section of the laundry treatment apparatus 1 according to an embodiment of the present disclosure. The inside of the laundry treatment apparatus 1 according to an embodiment of the present disclosure will be schematically described with reference to FIG. 2.

The laundry opening 17 of the front panel 15 may be shielded by the laundry door 40, and the user may open the laundry opening 17 by manipulating the laundry door 40 when the laundry is to be washed.

Clothes may be inserted into the opened laundry opening 17, and the clothes introduced through the laundry opening 17 may pass through the tub opening 22 of the tub 20 and a drum opening 32 of the drum 30 and may be introduced into the drum 30.

The tub 20 may be fixed inside the cabinet 10, and a front surface of the tub 20 facing the laundry opening 17 may be opened to form the tub opening 22. The tub 20 may be connected to the front panel 15 through a gasket for preventing separation of the clothes and preventing water leakage. The tub 20 may be supported on the cabinet 10 through a damper to minimize vibration transmitted to the cabinet 10.

The drum 30 may be disposed inside the tub 20, and a front surface of the drum 30, which faces the tub opening 22 and the laundry opening 17, may be opened to define the drum opening 32. That is, the laundry opening 17, the tub opening 22, and the drum opening 32 may be aligned in parallel to communicate with each other.

As described above, the drum 30 may have an outer circumferential surface in which a plurality of communication holes are formed, and thus water accommodated in the tub 20 may be provided into the drum 30. The drum 30 may be provided to be rotatable with a rotation shaft.

The drum 30 may be connected to the driver through the rotation shaft. The driver may provide a rotational force based on a signal of the controller 60, and the rotational force of the driver may be transmitted to the drum 30 through the rotation shaft to rotate the drum 30.

An embodiment of the present disclosure is described in terms of a front loader type laundry treatment apparatus in which the rotation shaft of the drum 30 extends and the laundry opening 17 is provided in the front panel 15 as shown in FIG. 2, but is not limited thereto, and the laundry treatment apparatus may be of a front loader type in which the laundry opening 17 is formed in an upper panel. However, the present disclosure will be described in terms of the front loader type laundry treatment apparatus unless otherwise stated.

The laundry treatment apparatus 1 according to an embodiment of the present disclosure may be connected to an external water supply source to receive water. A water supply unit connected to the external water supply source may be provided in the cabinet 10.

The water supply unit may include a water supply valve, and the controller 60 may supply water into the tub 20 in a washing process or the like through control of the water supply valve. The water supply unit may be provided to supply water into the tub 20 through the detergent supply device or to directly supply water into the tub 20 separately from the detergent supply device.

The detergent supply device may be connected to the water supply unit through a water supply hose. That is, the detergent supply device may be provided to receive water from the water supply unit and supply a detergent and water into the tub 20 or the drum 30 together.

The laundry treatment apparatus 1 according to an embodiment of the present disclosure may include a drainage unit, and the drainage unit may be connected to the tub 20 to discharge the water accommodated in the tub 20 to the outside.

FIG. 2 schematically illustrates the controller 60 provided inside the cabinet 10 according to an embodiment of the present disclosure. As described above, the controller 60 may be connected to a plurality of components such as the driver of the drum 30 and the control panel 100.

The controller 60 may be provided to perform a course for treating clothes based on a manipulation signal of the manipulator. For example, when receiving a course execution signal for laundry treatment through the manipulator, the controller 60 may control the water supply unit and the driver to perform the corresponding course.

The controller 60 may be provided in a partial space of the cabinet 10 or may be provided inside the control panel 100. For example, the controller 60 may be provided in the form of a module and may be provided in a base located on a lower panel of the cabinet 10.

The controller 60 may be provided inside the control panel 100, for example, a part of the screen output unit 8 or the manipulator. The controller 60 may include a plurality of segments and the segments may be provided on the control panel 100 and the base, respectively, to be operated together.

Referring to FIGS. 1 and 2, in an embodiment of the present disclosure, the controller 60 may be signally connected to a communication terminal 70 to be carried by a user. The communication terminal 70 may be separated from the cabinet 10 to be independently movable, may have a communication function, and may be provided to be carried by the user.

For example, the communication terminal 70 may correspond to a mobile phone to be carried by the user. FIGS. 1 and 2 schematically illustrate a communication terminal 70 corresponding to a mobile phone.

However, in an embodiment of the present disclosure, the communication terminal 70 is not necessarily limited thereto, and may be of various types for communicating directly or indirectly with the controller 60.

The controller 60 may be provided to communicate with the communication terminal 70 in various ways. That is, the controller 60 may be signally connected to the communication terminal 70 through various methods.

For example, the controller 60 may be directly connected to the communication terminal 70 through various methods for transmitting and receiving a wireless signal, such as Wi-Fi, Bluetooth, and NFC, or may be indirectly connected using an intermediate device provided inside or outside the laundry treatment apparatus 1 to transmit and receive a communication signal.

For example, the controller 60 may be connected to a Wi-Fi module provided inside or outside the laundry treatment apparatus 1 together with the communication terminal 70 to transmit and receive a signal to and from the communication terminal 70 through the Wi-Fi module.

Alternatively, the controller 60 may be connected to the Wi-Fi module or the like and transmit and receive a signal to the communication server corresponding to a terminal base station or the like for communication of the communication terminal 70, and thus may be signally connected to the communication terminal 70 through a communication server.

A communication method of the controller 60 is merely an example for describing an embodiment of the present disclosure, and is not limited to the above description, and the controller 60 and the communication terminal 70 according to an embodiment of the present disclosure may directly or indirectly transmit and receive signals between the controller 60 and the communication terminal 70.

An application for exchanging information with the laundry treatment apparatus 1 may be installed in the communication terminal 70 of the user, and various pieces of information provided from the controller 60 may be transmitted to the application through an external server or may be directly transmitted through Bluetooth.

The user may check various kinds of information of the laundry treatment apparatus 1 or command various settings and performance using the communication terminal 70 as well as the control panel 100 of the laundry treatment apparatus 1.

Figure 3:
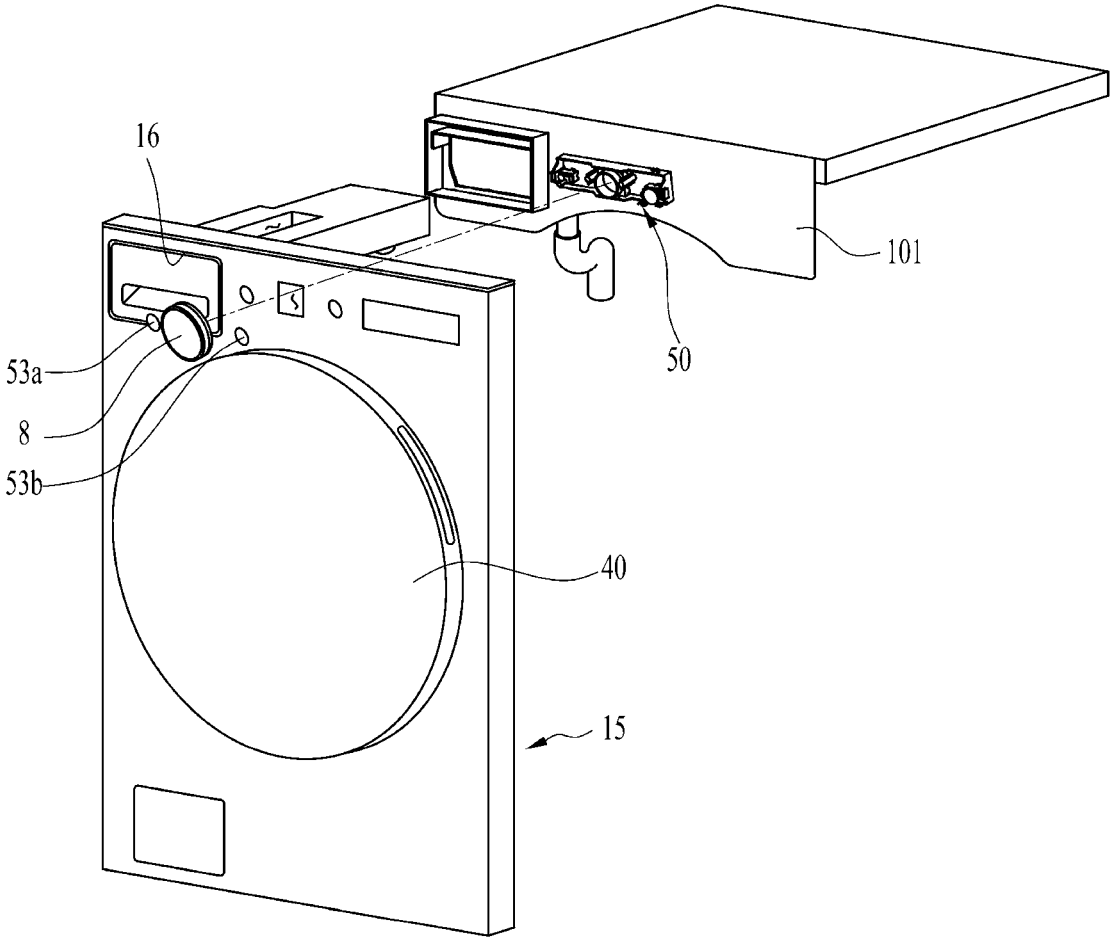
FIG. 3 is a diagram illustrating a state in which a front panel is disassembled in a laundry treatment apparatus according to an embodiment of the present disclosure.

FIG. 3 illustrates a state in which the front panel 15 is separated from the cabinet 10 in an embodiment of the present disclosure. The configuration of the front panel 15 will be described with reference to FIG. 3.

As described above, the front panel 15 includes the laundry opening 17 and the detergent opening 16. The laundry opening 17 may be opened and closed by the laundry door 40, and a storage unit of the detergent supply device may be inserted into the detergent opening 16.

A handle unit to be held by the user may be provided on a front end portion of the storage unit, and when the storage unit is inserted into the cabinet 10, a front surface of the handle unit may define the front surface of the laundry treatment apparatus 1 together with the front panel 15.

A panel support 101 may be provided behind the front panel 15 to improve the rigidity of the front panel 15 and to fix the screen output unit 8 or the manipulator of the control panel 100. The panel support 101 may be coupled to the front panel 15 or coupled to an upper panel and a side panel.

The panel support 101 may be provided in a plate shape extending in a width direction of the cabinet 10. The panel support 101 may correspond to a plate provided in parallel with the front surface of the cabinet 10. The panel support 101 may be disposed at an upper side of the front panel 15, and at least a portion of the screen output unit 8 and the manipulator may be coupled to each other.

The panel support 101 may be coupled to a panel flange of the front panel 15. The panel flange may have a flange shape extending rearward from an edge of the front panel 15, and the panel support 101 may be coupled to an upper side of the panel flange.

In an embodiment of the present disclosure, the screen output unit 8 and a portion of the manipulator may constitute a manipulation module 50. That is, in an embodiment of the present disclosure, the manipulation module 50 may include the screen output unit 8 and a portion of the manipulator.

The manipulation module 50 may be coupled to the panel support 101 behind the front panel 15. The manipulation module 50 may include a dial unit 56, a power button unit 53*a*, and an execution button unit 53*b*, which correspond to a portion of the manipulator together with the screen output unit 8.

An opening may be formed in the front panel 15 in such a way that the screen output unit 8 of the manipulation module 50 is exposed forward. That is, in the manipulation module 50 coupled and fixed to the panel support 101 behind the front panel 15, the plurality of buttons and the screen output unit 8 may be exposed forward through the opening of the front panel 15.

Figure 4:
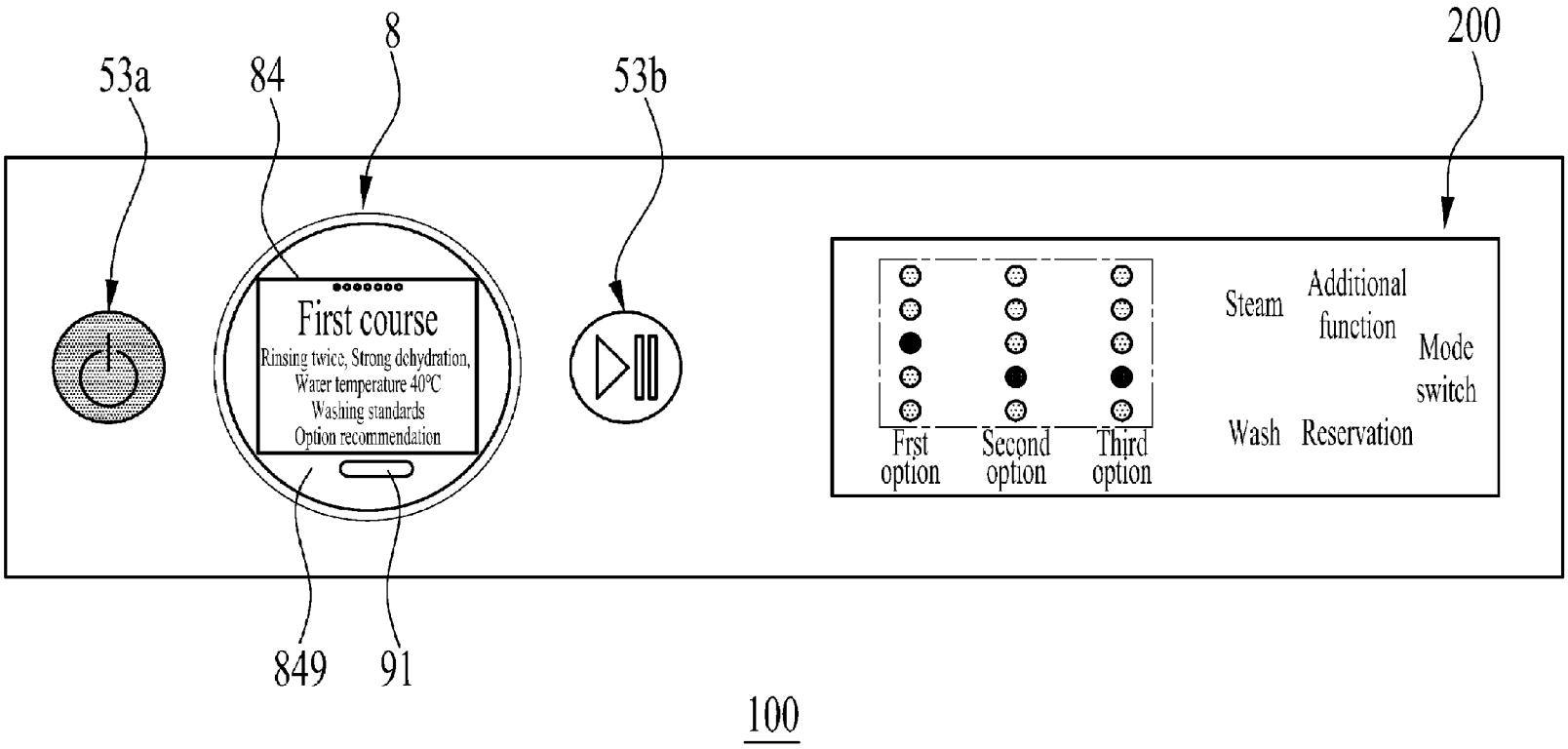
FIG. 4 is a diagram illustrating a control panel including a screen output unit and a manipulator in a laundry treatment apparatus according to an embodiment of the present disclosure.

FIG. 4 illustrates the control panel 100 according to an embodiment of the present disclosure. The control panel 100 according to an embodiment of the present disclosure will be described with reference to FIG. 4.

The control panel 100 may be provided on the cabinet 10 to define a part of an outer appearance of the laundry treatment apparatus 1. The control panel 100 may be provided at various positions such as a top panel or a front panel 15, and FIG. 1 illustrates a control panel 100 provided at an upper end portion of the front panel 15.

In an embodiment of the present disclosure, the control panel 100 may be provided on the front panel 15, the control panel 100 may be manufactured separately from the front panel 15 to be coupled to the front panel 15, or a part of the front panel 15 may correspond to the control panel 100.

The control panel 100 may have a bar-shaped plate shape extending in a width direction of the cabinet 10. When a portion of the front panel 15 corresponds to the control panel 100, the front panel 15 may have an opening in an area corresponding to the control panel 100, and the screen output unit 8 and the manipulator located behind the front panel 15 may be exposed to the front of the front panel 15 through the opening and identified or manipulated by the user.

Referring to FIG. 4, in an embodiment of the present disclosure, the control panel 100 may include the screen output unit 8, an option unit 200, the power button unit 53*a*, and an execution button unit 53*b*. As described below, the screen output unit 8 may include the dial unit 56 and the multi-function button unit 91, and the option unit 200 may include an option button unit and an additional option button unit.

The power button unit 53*a*, the execution button unit 53*b*, the dial unit 56, the multi-function button unit 91, the option button unit, and the additional option button unit may constitute the manipulator. That is, the manipulator may include the power button unit 53*a*, the execution button unit 53*b*, the dial unit 56, the multi-function button unit 91, the option button unit, and the additional option button unit.

The screen output unit 8 and the option unit 200 may be arranged in a width direction of the cabinet 10. Accordingly, the screen output unit 8 and the option unit 200 may be efficiently disposed in the control panel 100 extending in the width direction of the cabinet 10.

In an embodiment of the present disclosure, the control panel 100 may include the power button unit 53*a* and the execution button unit 53*b*. The power button unit 53*a* and the execution button unit 53 *b* may correspond to a portion of the manipulator. That is, the manipulator may include the power button unit 53*a* and the execution button unit 53*b*.

The user may operate the power button unit 53*a* to input power of the laundry treatment apparatus 1. The power button unit 53*a* may be provided as a touch type or a mechanical button type, and may generate a power signal corresponding to a manipulation signal when manipulated by a user.

The controller 60 may be on standby in a sleep state in which a signal from the power button unit 53*a* is to be input in a power-off state, and when receiving the power signal from the power button unit 53*a*, the current state may be converted into a sleep-on state, and the controller 60 may control the laundry treatment apparatus 1 to supply power to each component of the laundry treatment apparatus 1.

The user may manipulate the execution button unit 53*b* and command the laundry treatment apparatus 1 to perform a laundry treatment process P3 for treating clothes. The execution button unit 53*b* may be provided as a touch type or a mechanical button type, and when manipulated by the user, the execution button unit 53*b* generates an execution signal which is a kind of manipulation signal. When the execution signal is transmitted in a sleep-on state, the controller 60 may control the driver and the water supply unit to perform the laundry treatment process P3 for treating clothes.

The power button unit 53*a* and the execution button unit 53*b*, which need to be manipulated by the user and have high importance, may be independently disposed from the screen output unit 8 and the option unit 200 in use of the laundry treatment apparatus 1 according to an embodiment of the present disclosure, and thus the user may easily recognize the same.

The power button unit 53*a* and the execution button unit 53*b* may be disposed in the remaining areas except for the screen output unit 8 and the option unit 200 in the control panel 100. The power button unit 53*a* and the execution button unit 53*b* may be disposed at both sides of the screen output unit 8, respectively.

FIG. 4 illustrates a state in which the power button unit 53*a* is disposed at one side of the screen output unit 8 based on a width direction of the cabinet 10, and the execution button unit 53*b* is disposed at the other side of the screen output unit 8 according to an embodiment of the present disclosure. The execution button unit 53*b* may be disposed between the screen output unit 8 and the option unit 200.

Figure 5:
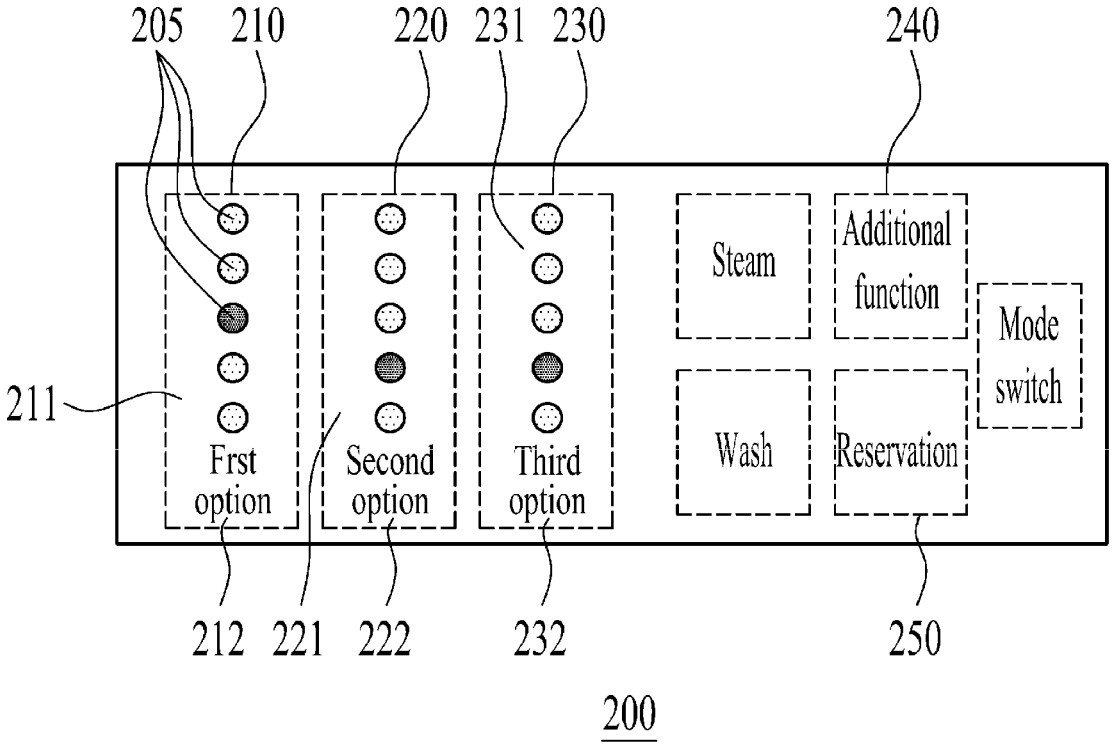
FIG. 5 is a diagram illustrating an option unit in a laundry treatment apparatus according to an embodiment of the present disclosure.

FIG. 5 illustrates the option unit 200. In an embodiment of the present disclosure, various courses for treating clothes are pre-stored in the controller 60, and the user may check an option state of each course or adjust an option through the option unit 200.

The option unit 200 may include a plurality of option adjusters that correspond to a plurality of options, respectively. According to an embodiment of the present disclosure, there are a plurality of options in which a plurality of option values selectable by the user exist, and the plurality of option adjusters are provided to adjust option setting values for different options, respectively.

In an embodiment of the present disclosure, any one option may include a plurality of option values selectable by the user, and any one of the plurality of option values may be set as an option setting value for a corresponding option to be applied to a course for treating clothes.

FIG. 5 illustrates the option unit 200 including a first option unit 200, a second option unit 200, and a third option unit 200 according to an embodiment of the present disclosure. The first option unit 200, the second option unit 200, and the third option unit 200 correspond to the option adjuster. That is, the option unit 200 may include the option adjuster, and the option adjuster may include the first option unit 200, the second option unit 200, and the third option unit 200.

The number of option adjusters may correspond to the number of adjustable options with respect to the course, and may be determined as various numbers. For example, one embodiment of the present disclosure may provide a first option for the number of rinses, a second option for the number of spin-dries, and a third option for a water temperature, and the option adjuster may also include the first option unit 200 for a first option, the second option unit 200 for a second option, and the third option unit 200 for a third option.

However, the number and contents of the above options are for convenience of description and are not limited to the above description, and the number of options and the number of option adjusters may vary, and specific option contents corresponding to the first, second, and third options may also vary as necessary.

The option adjuster included in the option unit 200 may include an option display unit and an option button unit. That is, the option unit 200 may include an option display unit and an option button unit, and the option button unit may correspond to a part of the above-described manipulator.

For example, in an embodiment of the present disclosure, the option unit 200 may include a plurality of option adjusters, the plurality of option adjusters may include a first option adjuster 210, a second option adjuster 220, and a third option adjuster 230, the first option adjuster 210 may include a first option display unit 211 and a first option button unit 212, and the second option adjuster 220 may include a second option display unit 221 and a second option button unit 222, and the third option adjuster 230 may include a third option display unit 231 and a third option button unit 232.

The option display unit may be provided to display a current option setting value of an option corresponding to the option adjuster, and the option button unit may be provided to change the option setting value of the option corresponding to the option adjuster.

That is, the user may operate any one option button unit among the plurality of option adjusters provided in the option unit 200 to generate a corresponding option adjustment signal for the option, and the controller 60 may change a target set as an option setting value among a plurality of option values for the corresponding option based on the option adjustment signal. That is, the controller 60 may change the option setting value of the corresponding option based on the option adjustment signal.

The option display unit may include a plurality of light emitting units 205. Each of the plurality of light emitting units 205 may correspond to an option value of an option corresponding to a corresponding option display unit. The option display unit may provide information on the option setting value of the corresponding option to the user through the light emitting characteristics of the plurality of light emitting units 205.

For example, in an embodiment of the present disclosure, the option adjuster may include a first option unit 200, the first option unit 200 may include a first option display unit 211 for displaying an option setting value of the first option, and the first option display unit 211 may include a plurality of light emitting units 205 respectively corresponding to the option values for the first option.

The user may change the option setting value of the first option by manipulating the first option button unit 212, and the first option display unit 211 may emit light in the light emitting unit 205, which corresponds to the currently set option setting value, to display the current option setting value to the user.

That is, when the first option button unit 212 is manipulated, the controller 60 may change the option setting value of the first option, and may control the first option display unit 211 to emit light in the light emitting unit 205 corresponding to the current option setting value of the first option.

The option unit 200 may further include an additional option button unit in addition to the option adjuster. The additional option button unit may be provided to set an additional option. For example, the user may manipulate the additional option button to apply, execute, cancel, or terminate the corresponding additional option.

In an embodiment of the present disclosure, unlike an option that is adjusted by the option adjuster, an additional option does not have a plurality of option values, and whether to apply an additional option or whether to perform the additional option may be determined.

For example, in an embodiment of the present disclosure, the additional option button unit may include a setting button unit 240, a reservation button unit 250, and a steam button unit.

The additional option button unit may be used with the steam button unit to set whether steam is applied or used with the setting button unit 240 to set only whether to perform a setting operation. However, the present disclosure is not necessarily limited thereto, and an additional option may also include a plurality of option values, such as an option adjusted by the option adjuster, or an option adjusted by the option adjuster may also be determined as the additional option.

When the setting button unit 240 of the additional option button unit is manipulated by the user, a setting screen 420 may be output on the screen output unit 8 and the setting operation may be performed. That is, when a setting signal of the setting button unit 240 is transmitted, the controller 60 may control the screen output unit 8 to output the setting screen 420 on the screen output unit 8.

When the reservation button unit 250 of the additional option button unit is manipulated by the user, a reservation screen may be output on the screen output unit 8 and a reservation operation may be performed. That is, when a reservation signal of the reservation button unit 250 is transmitted, the controller 60 may control the screen output unit 8 to output a reservation screen on the screen output unit 8. The setting operation and the reservation operation will be described below in detail.

In an embodiment of the present disclosure, the plurality of additional option buttons may be arranged in a grid form and may be efficiently arranged in an area of the option unit 200. In addition, the option adjuster may be provided to intuitively recognize a change in an option value by aligning the plurality of light emitting units 205 in a line.

FIG. 5 illustrates a state in which a plurality of option adjusters are aligned in a width direction of the cabinet 10, and the additional option button units are arranged in a grid form at one side of the option adjuster.

The option button unit and the additional option button unit constituting a part of the manipulator may be provided to display names of corresponding options. The option display unit, the option button unit, and the additional option button unit are provided to emit light, respectively, to improve appearance aesthetics, and at the same time, only the option adjuster or the additional option button unit corresponding to an option for manipulation for each course for treating clothes emits light, thereby providing convenience to the user.

Figure 6:
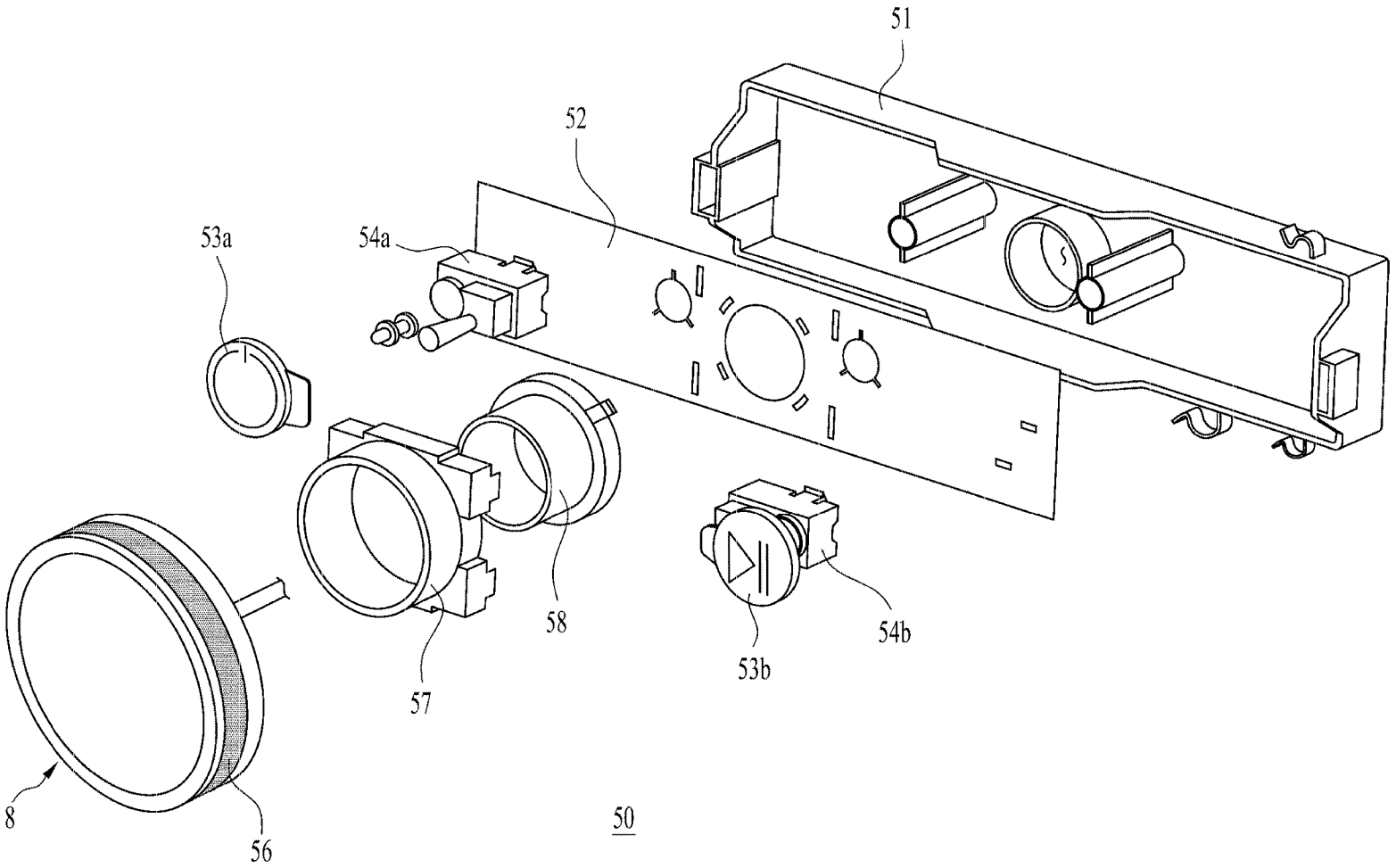
FIG. 6 is a diagram illustrating a state in which an operation module including a screen output unit is disassembled in a laundry treatment apparatus according to an embodiment of the present disclosure.

FIG. 6 is an exploded diagram of the manipulation module 50 according to an embodiment of the present disclosure. According to an embodiment of the present disclosure, the manipulation module 50 in which the screen output unit 8 and at least a portion of the manipulator are modularized together may be provided.

Although FIG. 6 illustrates a structure including the screen output unit 8, the power button unit 53*a*, and the execution button unit 53*b* in the manipulation module 50, a part of the manipulator may be additionally included in the manipulation module 50 or other configurations may be added to the manipulation module 50 as necessary.

Referring to FIG. 6, in an embodiment of the present disclosure, the manipulation module 50 may be provided inside the front panel 15. That is, the manipulation module 50 may be positioned between the front surface of the front panel 15 and the panel support 101. The inside of the front panel 15 may refer to a region surrounded by the front surface of the front panel 15 and the panel flange described above.

The inside of the front panel 15 may be located behind the front surface of the front panel 15 and may be opened rearward. The inside of the front panel 15 may be located at a front side of the upper panel, the side panel, and the lower panel.

The manipulation module 50 may be coupled to the front surface of the panel support 101 to be disposed inside the front panel 15. The manipulation module 50 may include a manipulation housing 51 coupled to the panel support 101. The manipulation housing 51 may include a substrate unit 52 electrically connected to the power button unit 53*a*, the execution button unit 53*b*, the dial unit 56, and the screen output unit 8.

The substrate unit 52 may be provided inside the manipulation housing 51, and may be connected to the power button unit 53*a*, the execution button unit 53*b*, and the screen output unit 8. The manipulation housing 51 may be filled with a sealer to ensure water-tightness after the substrate unit 52 is accommodated.

The power button unit 53*a* and the execution button unit 53*b* may include a power button housing and an execution button housing 54*b* coupled to the substrate unit 52, respectively. A power button housing 54*a* and an execution button housing may be coupled to or connected to the substrate unit 52 in various manners, and may include a button exposed to the front of the front panel 15.

The power button unit 53*a* and the execution button unit 53*b* may detect a physical force or an electric force transmitted by the user to generate an input signal of the user. For example, the power button unit 53*a* and the execution button unit 53*b* may each be a machine button unit for physically movement or a touch type button unit for detecting user touch without physical movement.

The power button unit 53*a* and the execution button unit 53*b* may be provided to generate an electrical signal when pressed by the user, or to generate an electrical signal to be transmitted to the controller 60 when the hand of the user is in contact with the button.

The manipulation module 50 may include the screen output unit 8, and the screen output unit 8 may include the dial unit 56. The screen output unit 8 may include an output housing 57 coupled to the substrate unit 52, and may include a rotation detector 58 configured to detect rotation of the dial unit 56.

The screen output unit 8 may provide the user with a screen corresponding to an output signal transmitted by the controller 60. At least a partial area of the screen output unit 8 may correspond to a touch area configured to receive a touch signal of the user. The dial unit 56 may be provided to surround a circumference of the screen output unit 8, and the user may rotate the dial unit 56 of the screen output unit 8 to transmit an input signal to the controller 60.

The rotation detector 58 may be provided inside the output housing 57, and may be connected to the dial unit 56 to detect rotation of the dial unit 56. The rotation detector 58 may include a magnetic generator and may correspond to an encoder including a fixed body and a rotating body.

The rotating body of the rotation detector 58 may be connected to the dial unit 56 to rotate together with the dial unit 56, and when the user rotates the dial unit 56, the rotation detector 58 may generate an electrical signal by rotation of the rotating body and transmit the electrical signal to the controller 60 by rotation of the rotating body.

According to an embodiment of the present disclosure, the manipulation module 50 may be provided inside the front panel 15, and thus, the front panel 15 may have a length sufficient to accommodate the manipulation module 50 in a front-rear direction. For example, a length in which the panel flange of the front panel 15 extends rearward may be greater than a length of the manipulation module 50 in the front-rear direction.

Figure 7:
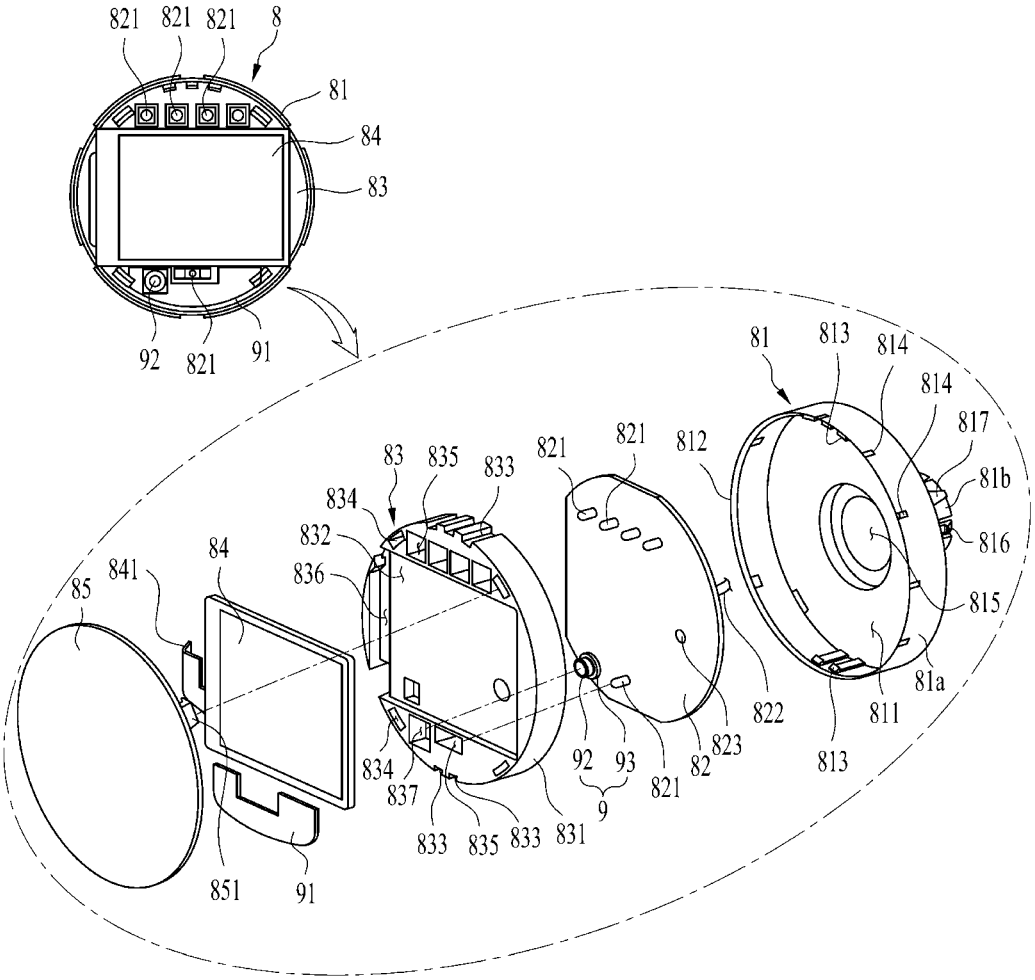
FIG. 7 is a diagram illustrating a state in which a screen output unit is disassembled in a laundry treatment apparatus according to an embodiment of the present disclosure.

FIG. 7 illustrates an example of the screen output unit 8, and the screen output unit 8 may include a housing 81 fixed to the rotation detector 58, a display 84 fixed to the housing and configured to display information (information related to control and operation of the laundry treatment apparatus), and a circuit board 82 provided in the housing and having a circuit for controlling the display 84.

The housing 81 may include a fastening body 81*b* fixed to the rotation detector 58 and an accommodation body 81*a* accommodated in the rotation detector 58.

The accommodation body 81*a* may be provided in any shape to be inserted into the rotation detector 58, and FIG. 7 illustrates an example in which the accommodation body 81*a* is provided in a cylindrical shape.

A mounting space 811 is formed inside the accommodation body 81*a*, and an accommodation body through hole 812 is provided in a space provided by the accommodation body 81*a*. The fastening body 81*b* may be provided in any shape to be inserted into the rotation detector 58. The fastening body 81*b* includes a fastening body through hole 815 connected to the mounting space 811.

A fixing body fastener 816 may be provided on a circumferential surface of the fastening body 81*b*. A plurality of positioning protrusions 817 may be further provided on the circumferential surface of the fastening body 81*b*.

The positioning protrusion 817 may have a shape to be inserted into a positioning groove provided in the rotation detector 58, and the positioning protrusion 817 may be provided at a position corresponding to the position of the positioning groove.

The positioning protrusion 817 and the positioning groove are devices configured to minimize a risk that the fixing body fastener 816 is not coupled to the fixed body when the fastening body 81*b* is inserted.

As shown in FIG. 7, the circuit board 82 of the display 84 may be inserted into the mounting space 811, and a wire 822 connected to the circuit board 82 of the display 84 may extend out of the housing 81 through the fastening body through hole 815. A plurality of lamps 821 may be provided on the circuit board 82 of the display 84.

To maintain an interval between the display 84 and the circuit board 82 of the display 84 and to prevent damage to the lamp 821, the mounting unit 83 located between the display 84 and the second circuit board 82 may be provided in the mounting space 811.

The mounting unit 83 may include a mounting body 831 fixed to the accommodation body 81*a* and located inside the mounting space 811. The mounting body 831 may be provided in any shape to be inserted into the mounting space 811, and FIG. 7 illustrates an example in which the mounting body 831 has a substantially cylindrical shape.

An accommodation groove 832 to which the display 84 is fixed may be provided in one surface of the mounting body 831. A connector through hole 836 may be provided in the accommodation groove 832, and a connector 841 (a flexible PCB) provided in the display 84 may be inserted into the connector through hole 836 to be connected to the circuit board 82 of the display 84.

A lamp through hole 835 into which the lamp 821 is inserted may be provided in the mounting body 831. The lamp through holes 835 may be provided with the same number as that of the lamps 821, and the position of the lamp through hole 835 needs to be set as a space of the mounting body located above the accommodation groove 832 or a space of the mounting body located below the accommodation groove 832. This is to transmit light emitted from the lamp 821 to the outside of the housing 81 through the lamp through hole 835.

The mounting unit 83 is fixed to the housing 81 through a mounting body fastener 813 provided in the accommodation body 81*a* and an accommodation body fastener 833 provided in the mounting body 831.

The mounting body fastener 813 may include a plurality of protrusions located inside the mounting space 811, and the accommodation body fastener 833 may be provided on a circumferential surface of the mounting body 831 (one surface of the mounting body, which is in contact with the accommodation body) and may include grooves to which the mounting body fastener 813 is fixed. A spacer 814 having a protrusion shape may be provided on a circumferential surface of the accommodation body 81*a*.

The number of the mounting body fasteners 813 and the number of the accommodation body fasteners 833 may be set to be the same, and the positions of the mounting body fastener 813 and the accommodation body fastener 833 need to be set to correspond to each other.

To increase a fastening force of the mounting body 831, the accommodation body fastener 833 may include an upper fastener positioned at a higher point than the accommodation surface 832, and a lower fastener positioned at a lower point than the accommodation surface 832. Unlike the diagrams, the accommodation body fastener 833 may be provided on each of the left and right sides of the accommodation surface.

A cover 85 may be further provided on the accommodation body 81*a* to prevent water and foreign substances from being introduced into the display 84 and the circuit board 82 of the display 84.

The cover 85 may be fixed to at least one of the accommodation body 81*a* and the mounting body 831 to close the accommodation body through hole 812. The cover 85 may be formed of a material having a transparency in such a way that information displayed on the display 84 and light emitted from the lamp 821 may be checked from the outside.

When the cover 85 is fixed to the mounting body 831, the cover 85 may include a cover fixing protrusion 851 protruding toward the mounting body 831, and the mounting body 831 may include a fixing protrusion fastener 834 to which the cover fixing protrusion 851 is coupled.

The circuit board 82 of the display 84 may also be fixed to the mounting body 831. That is, the mounting unit 83 may include a protrusion 838 protruding from the mounting body 831 toward the second circuit board 82, and the second circuit board 82 may include a protrusion through hole 823 into which the protrusion 838 is inserted.

The cover 85 may further include a cover sheet 853 for lowering the transparency of the cover. The transparency of the cover sheet may be set to an extent that the inside of the mounting space 811 is difficult to be checked from the outside.

The cover sheet 853 may be fixed to a surface of the cover 85, and characters or symbols may be provided in a region of the cover sheet, onto which the lamp through hole 835 is projected.

As shown in FIG. 7, the screen output unit 8 may further include a multi-function button unit 91 configured to receive a control command displayed on the display 84.

The multi-function button unit 91 may be provided to determine whether the control command displayed on the display 84 is selected by detecting whether the body of the user is in contact with the cover 85.

That is, the multi-function button unit 91 may include a sensor 93 provided on the second circuit board 82 to sense static electricity of the body of the user, and a conductor connecting the sensor 93 and the cover 85. The conductor may include a first conductor fixed to the cover 85 and a second conductor 92 having one end connected to the first conductor and the other end connected to the sensor 93. In this case, a conductor through hole 837 into which the second conductor 92 is inserted needs to be provided in the mounting body 831.

The sensor 93 and the second conductor 92 together may define a signal detector 9. The first conductor is a device for facilitating input of a control command by expanding an area in which the user is capable of contacting.

The screen output unit 8 having the above-described structure enables display of a control command, search of the displayed control command, and selection of the displayed control command, and a space required for installation may be minimized. However, the screen output unit 8 having the above-described structure requires a device for discharging water or foreign substances introduced therein to the outside.

The screen output unit 8 may include a sealing unit (fastening body sealing unit) configured to prevent foreign substances from flowing into the fastening body through hole 815, and a cover sealing unit 852 configured to block a space between the cover 85 and the accommodation body through hole 812.

The cover sealing unit 852 may include an adhesive material that is sprayed onto the accommodation body 81*a* along an edge of the cover 85 to fill a space between the cover 85 and the accommodation body 812 and fix the cover 85 to the accommodation body 812.

Figure 8:
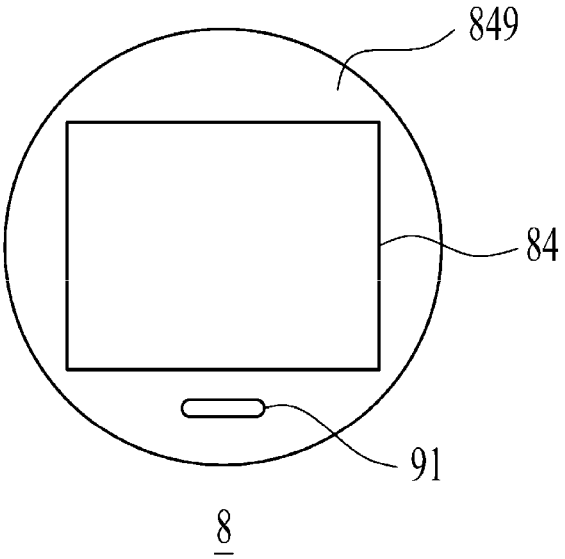
FIG. 8 is a diagram illustrating each configuration of a screen output unit in a laundry treatment apparatus according to an embodiment of the present disclosure.

FIG. 8 illustrates an outer appearance of the screen output unit 8 exposed to the outside through the control panel 100 according to an embodiment of the present disclosure. In an embodiment of the present disclosure, the screen output unit 8 may include the display 84 configured to output a screen configured to provide information to the user, a screen circumferential unit 849 into which the display 84 is inserted and fixed, and the multi-function button unit 91 provided in the screen circumferential unit 849 and manipulated by the user.

The screen circumference unit 849 may correspond to the remaining area except for an area of the display 84 in the aforementioned cover.

The screen output unit 8 may protrude forward from the control panel 100, and the aforementioned dial unit 56 may be disposed on an outer circumferential surface of the screen output unit 8. The screen output unit 8 may be provided to have a circular cross-section to facilitate rotation of the dial unit 56 corresponding to the rotating body.

The display 84 of the screen output unit 8 may be exposed to the outside to output a screen, and may have a rectangular cross-section. That is, the screen output unit 8 may have the rectangular display 84 disposed inside the screen circumferential unit 849 having a circular shape.

The multi-function button unit 91 may be provided to be exposed to the outside on the screen circumferential unit 849. As described above, the multi-function button unit 91 may be provided to react to static electricity present in the body of the user.

The multi-function button unit 91 may be provided between an outer edge of the screen circumference unit 849 and the display 84. In an embodiment of the present disclosure, the control panel 100 may be located on the front panel 15 of the cabinet 10, the screen output unit 8 may protrude forward from the control panel 100, and the multi-function button unit 91 may be located below the display 84 of the screen output unit 8.

The multi-function button unit 91 may be manipulated by the user to generate a manipulation signal, and the multi-function button unit 91 may be provided to vary a function according to a screen output on the screen output unit 8.

That is, the controller 60 may perform different functions according to a manipulation signal transmitted from the multi-function button unit 91 according to a screen output on the screen output unit 8. The controller 60 may disregard the manipulation signal of the multi-function button unit 91 or deactivate the multi-function button unit 91 according to the screen.

Figure 9:
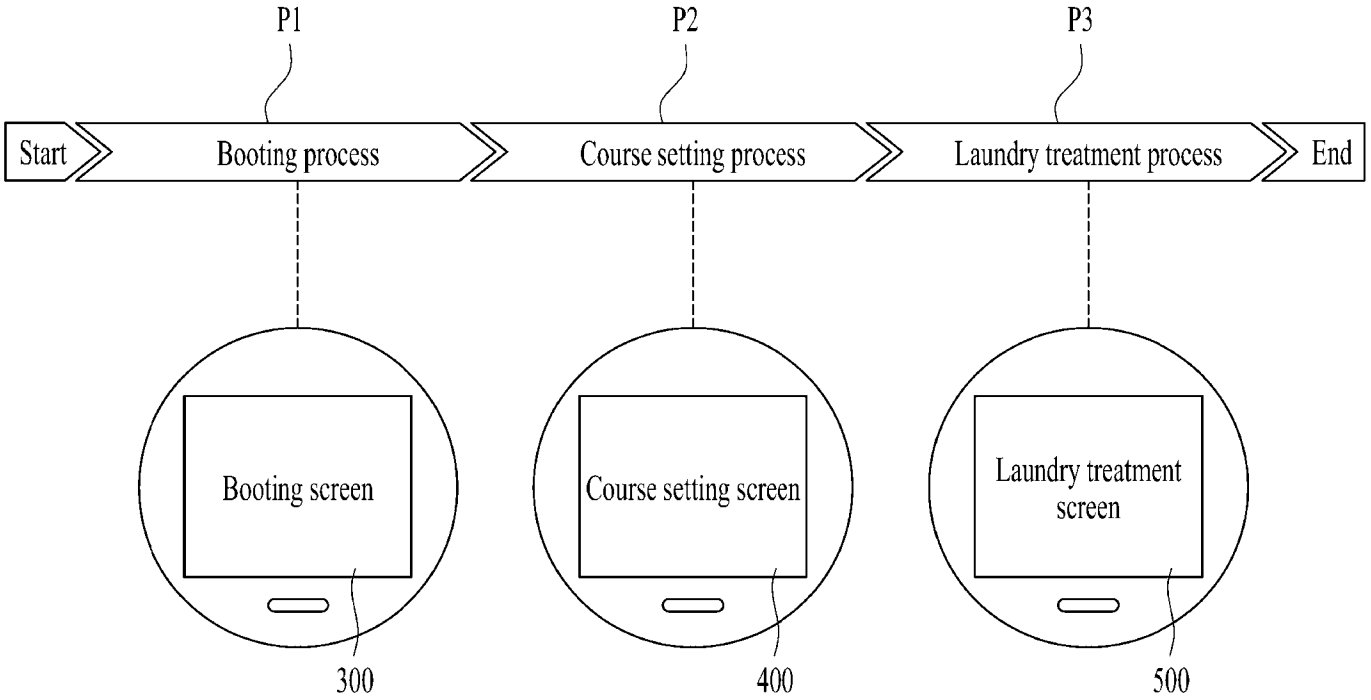
FIG. 9 is a schematic diagram illustrating screens output from a screen output unit according to each progress operation in a laundry treatment apparatus according to an embodiment of the present disclosure.

FIG. 9 schematically illustrates a screen change of the screen output unit 8 according to an operation process of the laundry treatment apparatus 1 according to an embodiment of the present disclosure.

The operation process of the laundry treatment apparatus 1 according to an embodiment of the present disclosure may include a booting process P1, a course setting process P2, and a laundry treatment process P3. The booting process P1 corresponds to a process in which power is input to each component of the laundry treatment apparatus 1 and programs stored in the controller 60 are booted.

The course setting process P2 corresponds to a process in which one of a plurality of courses for treating clothes is selected by a user, and various settings for the course are performed.

The laundry treatment process P3 corresponds to a process in which clothes are treated according to the course determined in the course setting process P2. In the laundry treatment process P3, the controller 60 controls the driver or other components and performs the course.

The screen output unit 8 may output a booting screen 300 in the booting process P1. The booting screen 300 may provide various information to the user in the booting process P1. For example, the booting screen 300 may provide various information such as a current temperature, weather, booting progress status, warning content, and notification content to the user.

That is, the controller 60 may be provided to control the screen output unit 8 to output the booting screen 300, and to provide the user with various information related to use of the laundry treatment apparatus 1 through the booting screen 300.

The screen output unit 8 may output a course setting screen 400 through the display 84 in the course setting process P2. The course setting screen 400 may provide information about various courses and settings to the user, and the user may set courses and options through the course setting screen 400.

For example, the controller 60 may control the screen output unit 8 to pre-store a plurality of courses for treating clothes and output a course selection screen 410 configured to display the plurality of courses on the screen.

When the user manipulates the manipulator through the screen displayed on the display 84, the controller 60 may perform the laundry treatment process P3 according to the course or the setting displayed on the display 84 based on a manipulation signal of the manipulator.

The screen output unit 8 may output a laundry treatment screen 500 through the display 84 in the laundry treatment process P3. The laundry treatment screen 500 may provide various pieces of information on the course currently performed to the user.

For example, the controller 60 may control the screen output unit 8 to output the laundry treatment screen 500, and may provide various information, such as the name of the course currently in progress in the laundry treatment screen 500, an execution time of the course, the current processing process in the corresponding course, and the remaining time, to the user.

Figure 10:
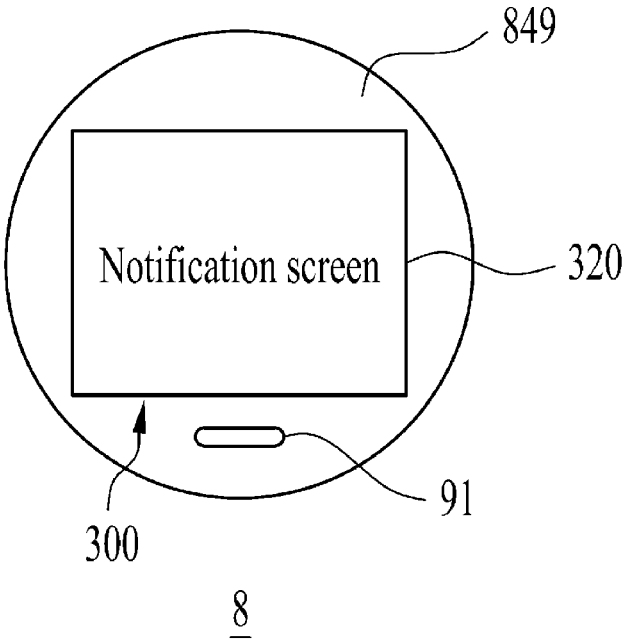
FIG. 10 is a diagram illustrating a notification screen of a booting screen output from a screen output unit of a booting process according to an embodiment of the present disclosure.

FIG. 10 is a diagram schematically illustrating a notification screen 320 of the booting screen 300 output from the screen output unit 8 according to an embodiment of the present disclosure.

In an embodiment of the present disclosure, the screen output unit 8 may be provided to provide various information to a user in a preparation process of each component of the laundry treatment apparatus 1 through the booting screen 300. The booting screen 300 may include a plurality of screens that provide different information. In an embodiment of the present disclosure, the notification screen 320 illustrated in FIG. 10 may correspond to a part of the booting screen 300.

Various information may be displayed in the notification screen 320 to be visually provided to the user. The notification screen 320 may display various information prior to use of the laundry treatment apparatus 1, such as the current weather, temperature, water temperature, and remaining amount of a detergent, and the like.

Figure 11:
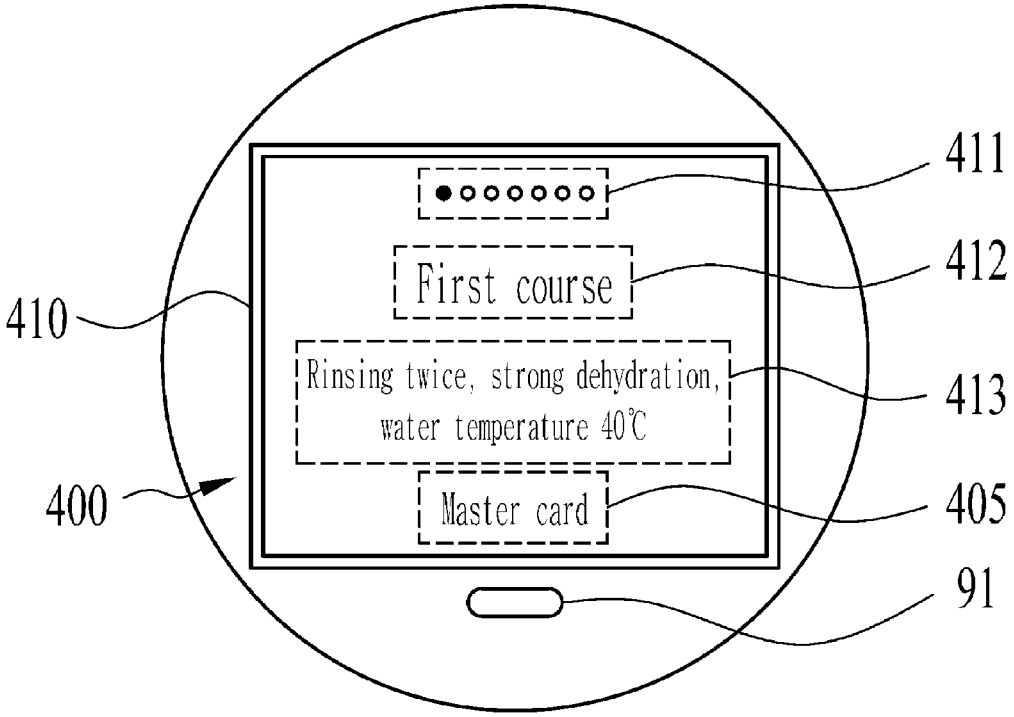
FIG. 11 is a diagram illustrating a course selection screen among course setting screens output from a screen output unit of a course setting process according to an embodiment of the present disclosure.

FIG. 11 is a diagram schematically illustrating the course selection screen 410 of the course setting screen 400 output from the screen output unit 8 according to an embodiment of the present disclosure.

In an embodiment of the present disclosure, the course setting screen 400 output from the screen output unit 8 may include various screens such as the course selection screen 410. That is, the course selection screen 410 is a kind of course setting screen 400 output from the screen output unit 8.

FIG. 11 illustrates the course selection screen 410 as an example of the course setting screen 400 according to an embodiment of the present disclosure. The course selection screen 410 may display a plurality of courses for treating clothes, and any one of the plurality of courses may be selected by a user.

The course selection screen 410 may include an order display area 411, a course name area 412, an option guide area 413, and a function display area 405. The order display area 411 is an area indicating an ordinal number of the currently displayed course among the plurality of courses to be displayed to the user through the course selection screen 410.

In an embodiment of the present disclosure, the controller 60 may pre-store a plurality of courses for treating the clothes, and display the plurality of courses to the user through the screen output unit 8 to allow the user to directly select any one of the plurality of courses.

However, the screen output unit 8 may display information in a limited area through the display 84, and accordingly, it may be inefficient to simultaneously display the plurality of courses. Accordingly, according to an embodiment of the present disclosure, a plurality of courses may be sequentially displayed in the course selection screen 410, thereby effectively displaying a plurality of courses in a limited screen area.

According to the above circumstances, in an embodiment of the present disclosure, the course selection screen 410 may include the order display area 411 configured to notify the user of an ordinary number of the currently displayed course, and the user may conveniently check order information of the course currently displayed for the plurality of courses through the order display area 411.

FIG. 11 illustrates a case in which the order display area 411 displays a plurality of circular objects corresponding to the respective courses and a circular object corresponding to the currently displayed course has a different illuminance from the remaining circular objects on the course selection screen 410 to notify the user of an ordinal number of the currently displayed course. However, a specific shape of the order display area 411 may be determined in various ways for indicating the ordinal number of the current course for the plurality of courses.

A name of a course currently displayed in the course selection screen 410 may be displayed in the course name area 412. The user may identify the course currently displayed through the course name area 412.

An option setting value for the currently displayed course may be displayed in the option guide area 413. As described above, for the plurality of courses, a plurality of options may be set by a user, and the option may have a plurality of option values that may be selected by a user, and any one of the plurality of option values may be designated as an option setting value for the option and applied in performance of the corresponding course.

According to an embodiment of the present disclosure, an option setting value of each of the plurality of options for the corresponding course may be displayed through the option guide area 413 of the course selection screen 410 to allow the user to conveniently check the current option setting state for the corresponding course on the course selection screen 410 configured to display the course.

A current function of the multi-function button unit 91 according to a screen currently displayed in the screen output unit 8 may be displayed in the function display area 405. Accordingly, the user may conveniently and intuitively check the result of manipulation of the multi-function button unit 91 for each screen.

In an embodiment of the present disclosure, contents for indicating entry into an option recommendation screen 460 may be displayed in the function display area 405 of the course selection screen 410, and details of the option recommendation screen 460 will be described below.

According to an embodiment of the present disclosure, a plurality of areas may be efficiently set to effectively and conveniently transmit various pieces of information to the user even in a limited output area in the course selection screen 410.

In an embodiment of the present disclosure, a plurality of courses for treating clothes may be stored in the controller 60, whether to designate a display group to be displayed in the course selection screen 410 for each of the plurality of courses may be set, and whether to designate the display group may be changed by the user.

Referring to FIG. 11, point areas respectively corresponding to a plurality of courses designated as the display group may be displayed in the order display area 411. The total number of the point areas may be the same as the total number of the courses of the display group, and a point region corresponding to the currently displayed course may be expressed through a difference in brightness.

The order display area 411 may be located at an upper end of the display 84, and a selection course display area 412 may be located under the order display area 411. The selection course display area 412 may be located approximately at the center of the display 84.

A name of the currently displayed course may be displayed in the selection course display area 412, and the visibility of the user may be ensured while having the largest character size in relation to the other area.

The option guide area 413 may be disposed under the selection course display area 412. The option guide area 413 may be located at the center of the display 84 together with the selection course display area 412, and may be located below the selection course display area 412.

An option setting value of each of a plurality of options may be displayed in the option guide area 413. A name of each of a plurality of options and an option setting value of each option may be displayed in the option guide area 413.

A character displayed in the option guide area 413 may be displayed in a smaller size than a characteristic of the selection course display area 412, and may be displayed at a brightness lower than that of the selection course display area 412.

The function display area 405 may be disposed below the option guide area 413. The function display area 405 may be located at a lower end of the display 84. The character displayed in the function display area 405 may be displayed at a lower size than that of the selection course display area 412.

Figure 12:
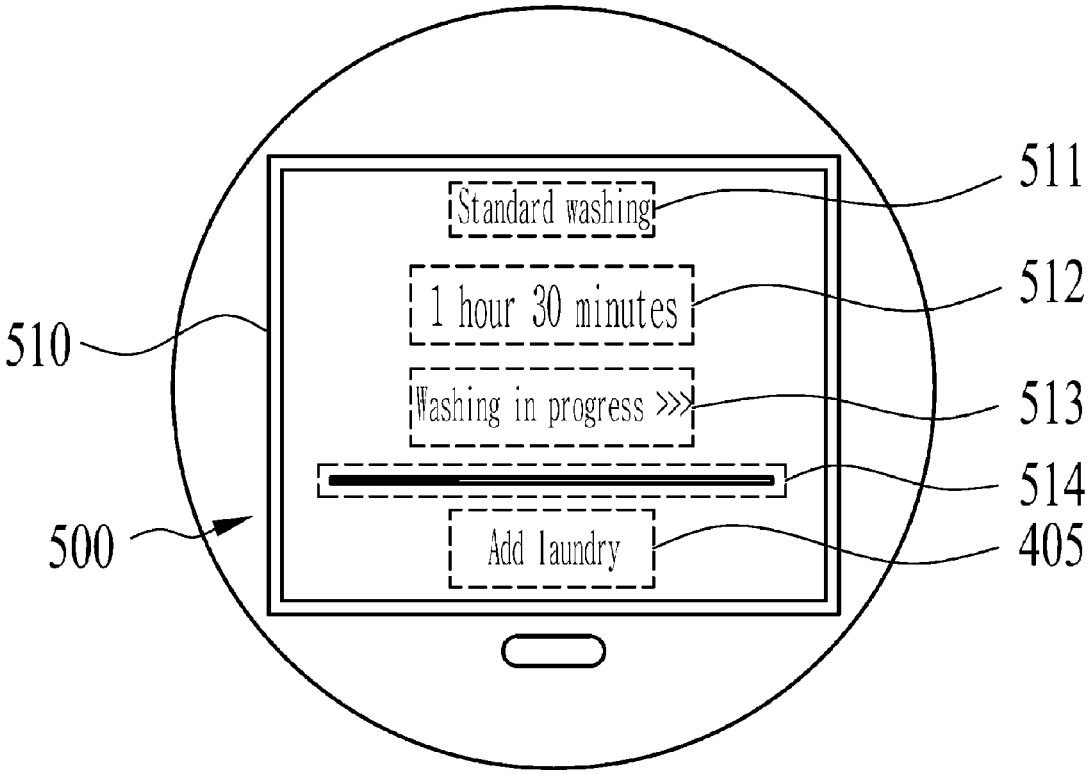
FIG. 12 is a diagram illustrating a course progress screen of a laundry treatment screen output from a screen output unit of a laundry treatment screen according to an embodiment of the present disclosure.

FIG. 12 illustrates a course progress screen 510 of the laundry treatment screen 500 output from the screen output unit 8 in an embodiment of the present disclosure. That is, the course progress screen 510 corresponds to one of the laundry treatment screens 500, and FIG. 12 illustrates an example of the course progress screen 510 as an example of the laundry treatment screen 500.

Through the course selection screen 410 of the screen output unit 8, the user may check various information of a course for treating clothes, and when any one course is specified through the aforementioned dial unit 56 and execution button unit 53*b*, the controller 60 may perform the course specified by the user based on a manipulation signal such as the dial unit 56 and the execution button unit 53*b*.

The plurality of courses for treating clothes may include a standard washing course for washing clothes or a standard drying course 4102 for drying clothes, and when any one is selected by the user, the controller 60 may control the water supply unit, the driver, the air supply unit, and the drainage unit to perform the corresponding course.

In the laundry treatment process P3 of performing the corresponding course, the controller 60 may control the screen output unit 8 to output the course progress screen 510, and the controller 60 may provide various information on the currently performed laundry treatment process P3 to the user through the course progress screen 510.

Referring to FIG. 12, in an embodiment of the present disclosure, the course progress screen 510 may include a progress course display area 511, a time display area 512, a process display area 513, a completion display area 514, and the function display area 405. However, the configuration of the course progress screen 510 is not necessarily limited as described above, and may vary as necessary.

The progress course display area 511 may display a name of the course currently performed in the laundry treatment process P3, and the user may check the currently performed course through a course display area 461.

The time display area 512 may display an elapsed time or the remaining time of the currently performed course, and the user may conveniently check a performance degree or end time of the currently performed course through time information displayed in the time display area 512.

The process display area 513 displays a current treatment process of the currently performed course. In an embodiment of the present disclosure, a course for treating clothes may include a plurality of treatment processes. For example, the standard washing course may include a water supply process, a detergent input process, a washing process, a rinsing process, a drainage process, and a spin-dry process.

That is, in an embodiment of the present disclosure, when any one course is performed, a plurality of processes for a corresponding course may be performed, and the controller 60 may display a currently ongoing process to the user through the process display area 513 of the course progress screen 510, thereby allowing the user to ensure the intuitiveness for the laundry treatment process P3 and effectively check the current treatment process.

The completion display area 514 displays a progress up to now with respect to an entire course that is currently performed. The completion display area 514 may display percentage converted from a completion degree or may be displayed in the form of a bar as shown in FIG. 12.

According to an embodiment of the present disclosure, the user may simply and effectively check a progress of the currently performed course through the completion display area 514. Unlike the time display area 512 configured to display only the remaining time, the completion display area 514 configured to display the current process during the entire course may provide convenience to the user.

The course progress screen 510 of the laundry treatment screen 500 may include the function display area 405 configured to display a function of the multi-function button unit 91 like the course selection screen 410 described above. That is, the multi-function button unit 91 may be activated on the course progress screen 510.

When the multi-function button unit 91 is activated, the multi-function button unit 91 itself or a part of the screen output unit 8, for example, an edge area of the multi-function button unit 91 may emit light to effectively express the availability of the multi-function button unit 91 to the user.

Figure 13:
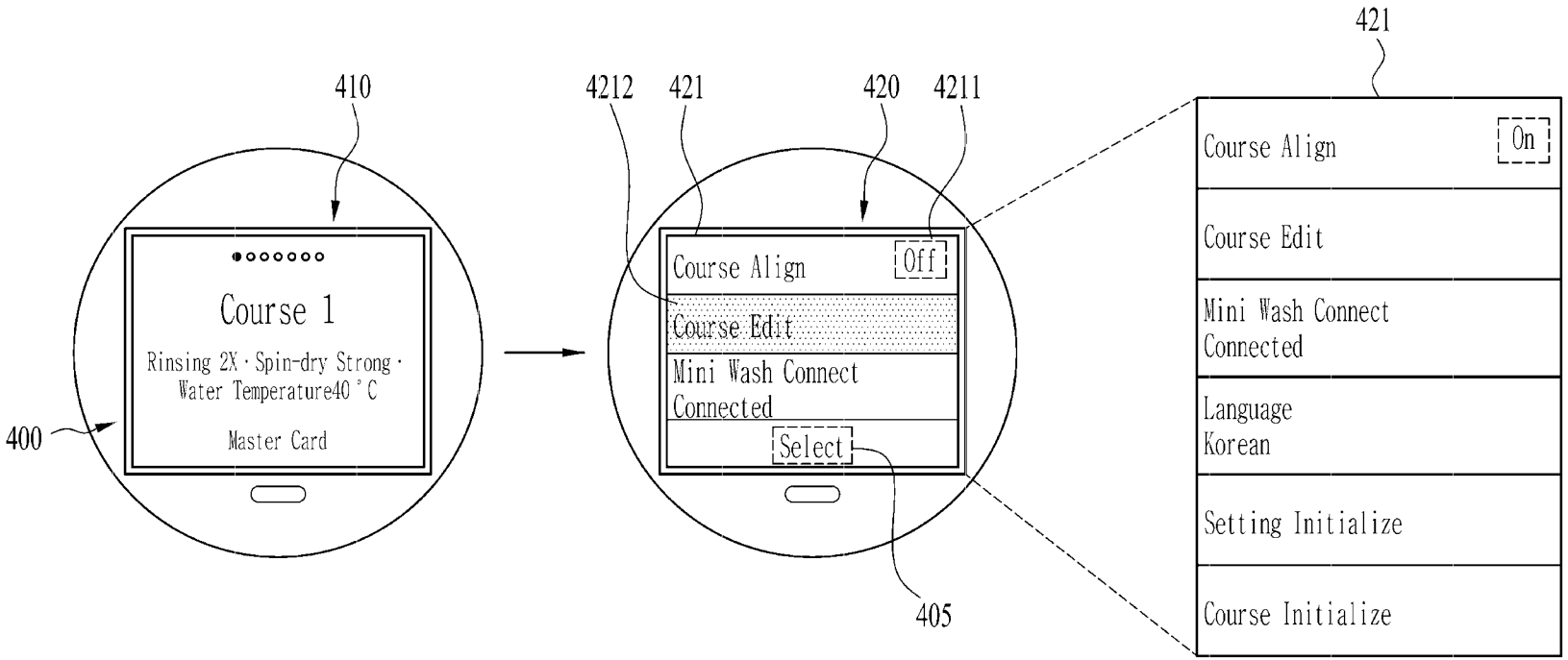
FIG. 13 is a diagram illustrating a setting screen output from a screen output unit according to an embodiment of the present disclosure.

FIG. 13 is a diagram illustrating the setting screen 420 of the course setting screen 400 output from the screen output unit 8 in an embodiment of the present disclosure.

As described above, according to an embodiment of the present disclosure, the cabinet 10, the drum 30, the manipulator, the screen output unit 8, and the controller 60 may be provided, and in this case, the drum 30 is provided inside the cabinet 10, is rotatably provided, and accommodates clothes therein.

The manipulator may be provided in the cabinet 10 and may be manipulated by a user to generate a manipulation signal. The screen output unit 8 may be provided in the cabinet 10 and may output a screen for providing information to the user. The controller 60 may be signally connected to the manipulator and the screen output unit 8, and may store a plurality of courses for treating clothes accommodated in the drum 30.

In an embodiment of the present disclosure, the controller 60 may be provided to designate and store at least some of the plurality of courses as a display group, the screen output unit 8 may be provided to output the course selection screen 410 on which courses designated as the display group are displayed, the controller 60 may be provided to perform a course selected from the course selection screen 410, and whether to designate each of the plurality of courses as the display group may be provided to be changeable by the user through the manipulator.

In detail, various courses for treating clothes such as a standard washing course, the standard drying course 4102, and a spin-dry course may be pre-stored in the controller 60. The screen output unit 8 may display the plurality of courses to the user in the course setting process P2 and output the course selection screen 410 for selecting any one of the plurality of courses based on the manipulation signal of the manipulator.

That is, the controller 60 may display the plurality of courses in the course setting process P2 after the booting process P1, and control the screen output unit 8 to output the course selection screen 410 selected by the user.

To efficiently display a plurality of courses in a limited area of the display 84, the screen output unit 8 may be provided to selectively display only one of the plurality of courses on the course selection screen 410.

The course displayed in the course selection screen 410 may be changed based on a manipulation signal of the manipulator. For example, when the user rotates the dial unit 56 described above in the course selection screen 410, a plurality of courses may be sequentially displayed one by one.

However, the controller 60 may store a plurality of courses to satisfy various needs of the user, and when all of the plurality of courses are displayed in the course selection screen 410, an unnecessary course may be provided according to a user, and may cause inconvenience when the number of courses is excessively high.

Accordingly, according to an embodiment of the present disclosure, the user may designate and use the course displayed in the course selection screen 410 with respect to the plurality of courses stored in the controller 60, thereby effectively satisfying the demand for each user and effectively improving use convenience.

In an embodiment of the present disclosure, a display group to be displayed in the course selection screen 410 among a plurality of pre-stored courses may be set in the controller 60. That is, only the courses designated as the display group among the plurality of courses are displayed in the course selection screen 410, and the user may check and select only the courses designated as the display group from the course selection screen 410, thereby improving use convenience.

Whether each of the plurality of courses stored in the controller 60 is designated as a display group may be directly selected by the user. For example, the controller 60 may change and store whether to designate each of the plurality of courses as the display group based on the manipulation signal of the manipulator by the user.

Accordingly, the user may select the courses required by the user among the various courses stored in the controller 60 and designate the selected courses as the display group, and the display group to which a request of the user is applied may be displayed in the course selection screen 410, thereby effectively improving a use environment of the user.

In more detail, as described above, the course selection screen 410 may include the order display area 411, the course name area 412, and the option guide area 413. The course name area 412 may display only the courses designated as the above-described display group.

Only one of the courses designated as the display group may be displayed in the course name area 412. An option setting value for the course displayed in the course name area 412 may be displayed in the option guide area 413. The user may manipulate the dial unit 56 and the like to change the course displayed in the course name area 412 and the option guide area 413 to a course of a next order or a previous order to determine whether to select the changed course.

The order and the number of courses displayed in the order display area 411 may be displayed depending on a setting state of the display group. That is, the number of courses displayed in the order display area 411 may correspond to the number of courses designated as the display group, and the order information of the current course displayed in the order display area 411 may correspond to the order information in the display group.

In an embodiment of the present disclosure, the remaining courses excluding the courses designated as the display group among the plurality of courses may be set not to be displayed in the course selection screen 410.

That is, the controller 60 may control the screen output unit 8 to display only the courses designated as the display group on the course selection screen 410. Accordingly, the user may select any one course for laundry treatment only on the courses corresponding to the display group to which a user intention is applied, from the course selection screen 410 of the screen output unit 8, thereby improving the efficiency of use.

Only one of the courses designated as the display group may be selectively displayed in the course selection screen 410, and the course displayed in the course selection screen 410 may be changed to another course based on the manipulation signal.

As described above, to effectively provide information in a limited area of the display 84, one of the courses set as the display group may be selectively displayed in the course selection screen 410.

In a state in which any one course is displayed in the course selection screen 410, the user may manipulate the manipulator, for example, the dial unit 56, to change the course displayed in the course selection screen 410.

According to an embodiment of the present disclosure, the user selects any one course through the course selection screen 410 and commands the controller 60 to perform the course, which will be described below.

The screen output unit 8 may output the course selection screen 410 under control of the controller 60, and only one of the courses designated as the display group may be displayed oin the course selection screen 410.

The user may check whether the currently displayed course is performed by checking the course name area 412 and the option guide area 413. When the user operates the above-described button unit 53*b* on the course selection screen 410 to generate the execution signal that is one of the manipulation signals, the controller 60 may apply the current option setting value to the course displayed in the course selection screen 410 to recognize the course to be selected by the user and perform the laundry treatment process P3 based on the corresponding course.

When the user requests course other than the course currently displayed in the course selection screen 410, the user may rotate the dial unit 56 to change the course displayed in the course selection screen 410 to another course.

That is, the user may rotate the dial unit 56 in a state in which the course selection screen 410 is output on the screen output unit 8 to display any one of various courses designated as the display group on the course selection screen 410, and may operate the execution button unit 53*b* while the course desired to be performed on the course selection screen 410 is displayed, thereby performing the course desired by the user.

As described above, the manipulator may include the dial unit 56. The dial unit 56 may be provided to be rotatable while surrounding the screen output unit 8.

When the dial unit 56 is rotated in one direction on the course selection screen 410, the screen output unit 8 may display a course corresponding to a next order of the currently displayed course, and when the dial unit 56 is rotated in another direction, the screen output unit 8 may display a course corresponding to a previous order of the currently displayed course.

The order information of the course may be stored in the controller 60, and the controller 60 may control the screen output unit 8 to display the course corresponding to the next order of the course displayed in the course selection screen 410 or the course corresponding to the previous order on the course selection screen 410 based on the rotation signal of the dial unit 56.

Figure 14:
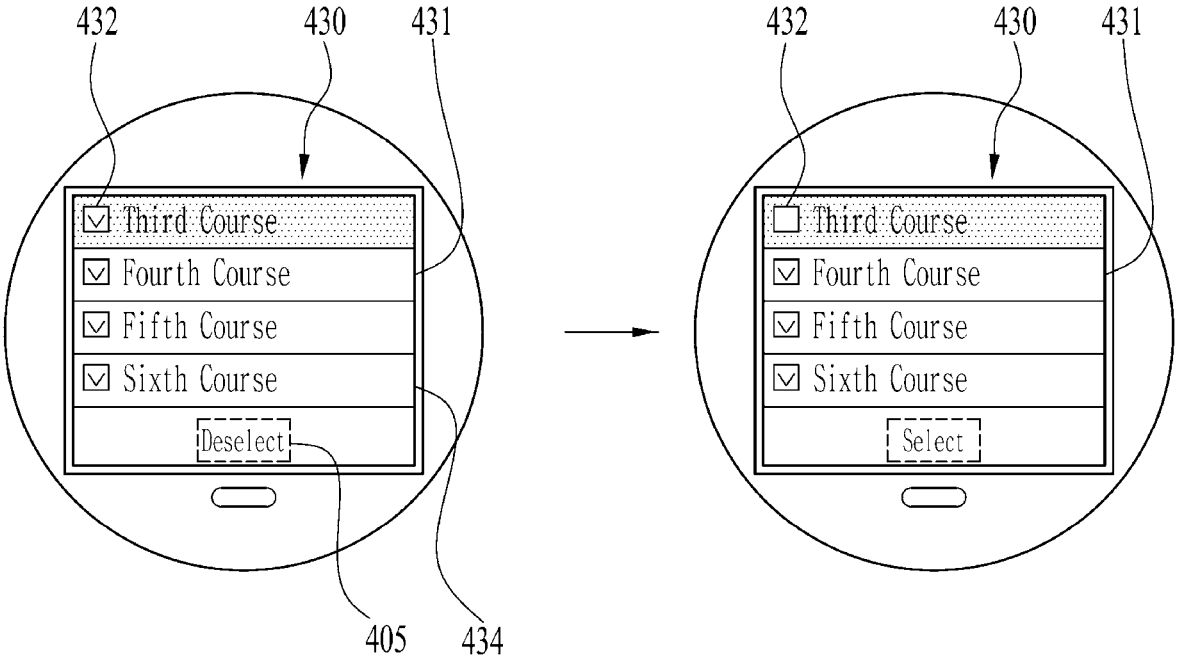
FIG. 14 is a diagram illustrating a course editing screen output from a screen output unit according to an embodiment of the present disclosure.

FIG. 14 illustrates a course editing screen 430 including a course list 431 on which a plurality of courses are displayed according to an embodiment of the present disclosure. In an embodiment of the present disclosure, the screen output unit 8 may be provided to output the course editing screen 430 on which the course list 431 including the plurality of courses is displayed based on the manipulation signal.

The user may command the manipulator to output the course editing screen 430. The controller 60 may control the screen output unit 8 to output the course editing screen 430 based on the manipulation signal of the manipulator.

For example, the user may output the setting screen 420 on the screen output unit 8 and display the setting list 421 including a course editing item 4212 on the setting screen 420, the user may select the course editing item 4212 using the dial unit 56 and the multi-function button unit 91, and when the course editing item 4212 is selected, the controller 60 may control the screen output unit 8 to output the course editing screen 430.

All courses stored in the controller 60 may be listed and displayed in the course list 431. That is, the user may entirely check the plurality of courses stored in the controller 60 through the course list 431 of the course editing screen 430, designate courses that the user intends to use in the course list 431 as a display group, and set a desired display group by releasing designation of courses that the user does not intend to use from the display group.

The screen output unit 8 may be switched from the course selection screen 410 to the course editing screen 430 based on the manipulation signal. To efficiently utilize a limited output area of the screen output unit 8, that is, an area of the display 84, when the course editing screen 430 needs to be output, the course editing screen 430 may be output instead of the course selection screen 410.

Through conversion and output of the screen, according to an embodiment of the present disclosure, various screens may be efficiently output in the limited area of the display 84.

In an embodiment of the present disclosure, the manipulator includes the setting button unit 240, and the screen output unit 8 may be switched to the setting screen 420 on which a plurality of setting items are displayed when a manipulation signal of the setting button unit 240 is generated in the course selection screen 410, and may be switched to the course editing screen 430 when the course editing item 4212 is selected from the plurality of setting items according to the manipulation signal on the setting screen 420.

FIG. 13 illustrates the setting screen 420 and the course editing item 4212. Referring to FIG. 13, in a state in which the course selection screen 410 is output on the screen output unit 8, when the setting button unit 240 is manipulated by the user, the controller 60 may control the screen output unit 8 to output the setting screen 420 instead of the course selection screen 410.

The setting screen 420 may display the setting list 421 including setting items related to settings for the overall environment of the laundry treatment apparatus 1 as well as setting of the currently displayed course.

FIG. 13 conceptually illustrates a state in which the course selection screen 410 is switched to the setting screen 420 according to a setting signal of the setting button unit 240. The setting list 421 may include a plurality of setting items such as language setting and initialization setting, and the screen output unit 8 may be provided to display a predefined number of setting items on the setting screen 420, on the setting screen 420, to efficiently express the plurality of setting items in the limited area of the display 84.

FIG. 13 illustrates an example of the setting list 421 stored in the controller 60, and illustrates an example in which a portion of the setting list 421 is displayed in the setting screen 420. However, the setting screen 420 and the setting list 421 shown in FIG. 13 are only examples for convenience of description, and the number of setting items simultaneously displayed in the setting list 421 or the entire setting item content of the setting list 421 may be variously changed as necessary.

In a state in which some of the plurality of setting items are displayed in the setting screen 420, the user may change the setting item displayed in the setting screen 420 through manipulation of the manipulator, such as rotating the dial unit 56.

That is, when the rotation signal of the dial unit 56 is generated in the setting screen 420, the controller 60 may control the screen output unit 8 to change and display the currently displayed setting item according to the order of the setting list 421.

FIG. 13 illustrates the setting screen 420 in which the course editing item 4212 is displayed in the screen output unit 8. A name indicating the course editing item 4212 may be variously determined.

In an embodiment of the present disclosure, when a plurality of items are displayed in a screen, the screen output unit 8 may be provided to display that one item is a selection target. FIG. 13 illustrates a state in which the course editing item 4212 among a plurality of setting items has a different color or illuminance from the remaining items and is displayed as the selection target.

In an embodiment of the present disclosure, a selection indication having a different color or illuminance from the remaining items may be applied to any one of the plurality of items, and an item to which the selection indication is applied corresponds to a current selection object. When the user manipulates the manipulator such as the multi-function button unit 91 or the execution button unit **53*b*, the controller 60** may recognize that the selection target to which the selection indication is applied is selected and perform a subsequent procedure.

In a state in which a plurality of items are displayed in the screen output unit 8, the user may rotate the dial unit 56 to change the selection target. For example, when the user rotates the dial unit 56 in one direction in the setting screen 420 of FIG. 13, the selection indication may be moved to an item below the course editing item 4212, and when the user rotates in the other direction, the selection indication may be moved to an item above the course editing item 4212.

When the user rotates the dial unit 56 again in one direction in a state in which the selection indication is applied to the lowermost item among the items displayed in the screen output unit 8, the screen output unit 8 may be provided to display the next item on the screen while not displayed in the current screen and remove the uppermost item among the items displayed in the current screen from the screen.

In a state in which the setting screen 420 is output on the screen output unit 8, the multi-function button unit 91 may be activated to have a selection function. That is, the controller 60 may be provided to recognize the manipulation signal of the multi-function button unit 91 as a selection signal in a state in which the setting screen 420 is output and to perform a subsequent procedure according to selection of the current selection target.

That is, according to an embodiment of the present disclosure, in the course setting process P2, when the course selection screen 410 is output on the screen output unit 8 and the user manipulates the setting button unit 240 in the course selection screen 410, the controller 60 may control the screen output unit 8 to output the setting screen 420 instead of the course selection screen 410 on the screen output unit 8, and when the user manipulates the multi-function button unit 91 in a state in which the selection indication is positioned in the course editing item 4212 by manipulating the dial unit 56 by the user in the setting screen 420, the controller 60 may determine the manipulation signal of the multi-function button unit 91 as a selection signal and control the screen output unit 8 to output the course editing screen 430 instead of the setting screen 420 on the screen output unit 8 according to selection of the course editing item 4212.

According to an embodiment of the present disclosure, various information may be effectively provided to the user by alternatively displaying the course selection screen 410, the setting screen 420, and the course editing screen 430 in one limited area of the display 84, the plurality of items may be efficiently displayed by displaying some of the plurality of items on the screen and allowing the user to change the displayed item, and the multi-function button unit 91 may be provided to have various functions as necessary, and accordingly, the user may conveniently manipulate the screen or select an item without adding a manipulator.

Referring to FIG. 13, in an embodiment of the present disclosure, the plurality of setting items may include a course alignment item 4211, and when the course alignment item 4211 is selected on the setting screen 420, the controller 60 may align and store the display order displayed in the course selection screen 410 according to a use frequency.

FIG. 13 illustrates the screen output unit 8 on which the setting list 421 including the course editing item 4212 and the course setting item is displayed, according to an embodiment of the present disclosure. When the user touches the multi-function button unit 91 in a state in which the user rotates the dial unit 56 to position the selection indication in the course alignment item 4211, the controller 60 may perform course alignment.

During course alignment, the controller 60 may set a display order of the courses of the display group according to a frequency of the course recently used in the laundry treatment process P3. For example, the controller 60 may set the display order from a course used with the highest frequency to a course used with the lowest frequency in a predefined number of laundry treatment processes P3.

According to an embodiment of the present disclosure, the course alignment item 4211 may be provided to the user, and thus the courses of the display group having the display order to which a frequency used by the user is applied may be provided to the user, thereby improving use convenience.

Referring to FIG. 14, in an embodiment of the present disclosure, whether to designate the display group for each of the plurality of courses may be displayed in the course list 431, and whether to designate the display group may be changed based on the manipulation signal.

In detail, a plurality of course items stored in the controller 60 may be displayed in the course list 431, and whether a display group is designated may be displayed in each course item. FIG. 14 illustrates a display group designation box 432 displaying a check mark for each course item. However, this is only an example for description of the present disclosure, and a specific form of displaying whether to designate the display group may vary.

Referring to FIG. 14, a check mark may be displayed in the display group designation box 432 designated as a display group among a plurality of course items, and a check mark may be removed from the display group designation box 432 that is not designated as the display group.

In detail, FIG. 14 illustrates a course list 431 including a third course and illustrates a state in which a selection indication is located in the third course. When the user manipulates the multi-function button unit 91 in a state in which the third course is designated as the display group, designation of the display group of the third course is displayed to be released.

In an embodiment of the present disclosure, when the manipulation signal of the multi-function button unit 91 is transmitted from the course editing screen 430, the controller 60 may invert whether the currently selected course is designated as the display group.

That is, in the course editing screen 430, the multi-function button unit 91 has a function of changing whether the display group is designated, and the controller 60 may invert whether the display group is designated when the manipulation signal of the multi-function button unit 91 is generated for any one course item.

For example, as illustrated in FIG. 14, when the manipulation signal of the multi-function button unit 91 is generated with respect to the third course in a state in which the third course of the plurality of courses is designated as the display group, the controller 60 may release designation of the display group of the third course.

When the manipulation signal of the multi-function button unit 91 is generated with respect to the third course in a state in which the third course is released from the display group, the controller 60 may designate and store the third course as the display group.

In an embodiment of the present disclosure, the multi-function button unit 91 may have a setting item selection function on the setting screen 420, and may have a function of changing designation of a display group in the course editing screen 430. That is, in an embodiment of the present disclosure, because the multi-function button unit 91 has different functions according to a screen of the screen output unit 8, various functions may be input even if different button units are not provided for each screen, and thus the multi-function button unit 91 may be advantageously designed and the user may use various functions by using only one multi-function button unit 91, thereby improving use convenience.

The screen output unit 8 may include the function display area 405 for displaying current function information of the multi-function button unit 91 on a currently output screen. Because the multi-function button unit 91 may have different functions according to a currently output screen, the content displayed in the function display area 405 may be changed according to the screen.

When the multi-function button unit 91 is deactivated not to function, the function display area 405 may be omitted from the screen output from the screen output unit 8.

For example, in an embodiment of the present disclosure, the multi-function button unit 91 has a function of selecting each setting item in the setting screen 420, and the setting screen 420 may include the function display area 405 in which a selection function of the multi-function button unit 91 is displayed.

In FIG. 13, the function display area 405 of the setting screen 420 displays a selection function of the multi-function button unit 91 as "selection", but this is variously determined as necessary.

In an embodiment of the present disclosure, the multi-function button unit 91 may have a function of changing designation of a display group for each course item in the course editing screen 430, and in detail, may have a display group release function for a course item designated as the display group and a display group designation function for a course item released from the display group.

Accordingly, the function of the multi-function button unit 91 may be changed according to the current selection target, and the display group designation function or the display group release function of the multi-function button unit 91 may be displayed in the function display area 405 of the course editing screen 430.

That is, in an embodiment of the present disclosure, the function display area 405 of the setting screen 420 and the function display area 405 of the course editing screen 430 may have different indications, and further, the function display area 405 may have different indications according to the selection target in the course editing screen 430.

In FIG. 14, when the course item designated as the display group is a selection target, a function name of "deselect" is displayed in the function display area 405, and when the course item released from the display group is the selection target, a function name of "select" is displayed in the function display area 405 to display different indications for respective items.

However, the names of the "deselect" and "select" in FIG. 14 are only examples of the contents of the function display area 405, and specific names may be variously changed as necessary.

According to an embodiment of the present disclosure, the multi-function button unit 91 may have different functions for respective screens, and the multi-function button unit 91 may have different functions according to a selection target on the same screen, thereby enabling the user to input various commands using one button.

The function display area 405 configured to display a function of the multi-function button unit 91 may be provided on the screen displayed in the screen output unit 8, the user may conveniently check and use the function of the multi-function button unit 91.

In an embodiment of the present disclosure, the controller 60 may be provided to exchange information with the communication terminal 70 to be carried by the user, and synchronize the course list 431 with the terminal course list 431 stored in the communication terminal 70.

As described above, the laundry treatment apparatus 1 according to an embodiment of the present disclosure may be provided to exchange information with a communication terminal 70 to be carried by the user through a server, and an application for controlling an operation of the laundry treatment apparatus 1 or checking information may be installed in the communication terminal 70.

The user may edit the course list 431 through the application of the communication terminal 70, and the result of editing the course list 431 may be transmitted to the controller 60 from the communication terminal 70 to synchronize the course list 431 pre-stored by the controller 60 with the course list 431 edited by the communication terminal 70.

The course list 431 edited through the course editing screen 430 of the screen output unit 8 may be transmitted to the communication terminal 70, and the user may conveniently check and edit the current course list 431 through the communication terminal 70.

Referring to FIG. 14, the plurality of courses may include a fixed course 434 in which the display group release is impossible, and the course list 431 may be displayed to separate the fixed course 434 and the remaining courses from each other.

The controller 60 may store some of the plurality of courses as the fixed course 434 in which the display group release is impossible. The fixed course 434 may correspond to a basic course or may be determined in other strategic aspects in use of the laundry treatment apparatus 1.

According to an embodiment of the present disclosure, the user may directly edit the courses displayed in the course selection screen 410 of the screen output unit 8, but when the user releases designation of the basic courses from the display group through a simple mistake or the like, the user may experience confusion by not displaying the basic course on the course selection screen 410.

That is, according to an embodiment of the present disclosure, the plurality of courses stored in the controller 60 may be stored as the fixed course 434 in which the user is not capable of arbitrarily releasing designation of the display group with respect to courses that are basic and need to be potentially used, thereby effectively ensuring the stability of use.

The fixed course 434 in the course editing screen 430 of the screen output unit 8 may be displayed to be distinguished from other courses. In FIG. 14, a course item displayed as "sixth course" is displayed to have a lower brightness unlike the other course items.

However, a method of displaying the fixed course 434 illustrated in FIG. 14 is merely an example for describing an embodiment of the present disclosure, and a method of displaying the fixed course 434 may be variously determined as necessary.

In an embodiment of the present disclosure, the controller 60 may store a display order according to an order of designation as the display group with respect to courses of the display group, and the screen output unit 8 may sequentially change the currently displayed course according to the display order based on the manipulation signal of the manipulator on the course selection screen 410.

That is, the controller 60 may set the display order of the courses of the display group according to the order of designation as the display group by the user. For example, the course designated as the most recent display group by the user may have the best order or the last order by the controller 60.

As described above, the screen output unit 8 may sequentially display the course of the display group on the course selection screen 410 one by one, and sequentially display the courses of the display group one by one according to the display order set by the controller 60.

The course designated by the user as the recent display group through the course editing screen 430 may correspond to a course that the user recently intends to use, and thus, according to an embodiment of the present disclosure, the courses may be displayed in the screen in the order of displaying the display group according to the order designated by the user on the course selection screen 410, thereby improving convenience of the user.

The fixed course 434 has an independent display order with respect to the courses designated as the display group, and the remaining courses obtained by excluding the fixed course 434 among the courses of the display group may avoid the display order of the fixed course 434 and the display order may be determined.

The fixed course 434 may correspond to a generally or commonly used course regardless of intention of the user, and accordingly, the fixed course 434 may also be differentiated from the remaining courses in terms of the display order, such as being displayed first or displayed last than the courses in the display group selected by the user.

For example, a standard washing course corresponding to a general washing course may correspond to a representative course in a washing process, and the standard washing course may be designated as the fixed course 434 and may have a first display order throughout the display group regardless of the display order of the remaining courses.

In the laundry treatment process P3, a tub sterilization course that is strategically recommended to the user for hygiene reasons is not used in the general laundry treatment process P3, but may be designated as the fixed course 434 to be recommended to the user. However, the tub sterilization course may have a final display order considering a use frequency.

As described above, according to an embodiment of the present disclosure, the fixed course 434 in which it is impossible to change designation of the display group for various reasons may be set, and the display order of the fixed course 434 may be strategically determined differently from the remaining courses, thereby effectively improving use convenience.

Figure 15:
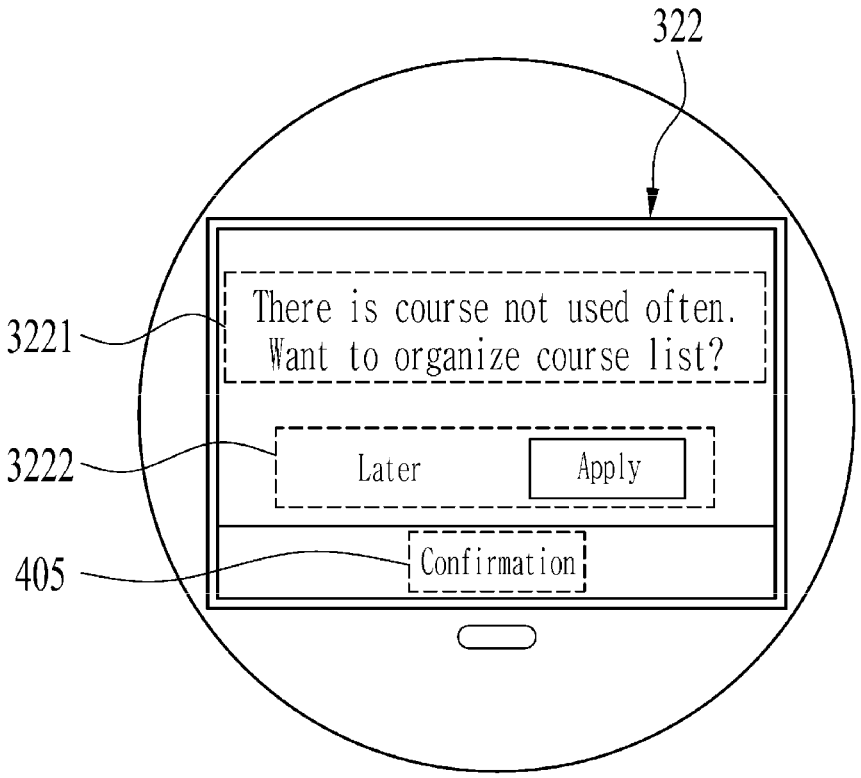
FIG. 15 is a diagram illustrating a course organization screen output from a screen output unit according to an embodiment of the present disclosure.

FIG. 15 illustrates a course organization screen 322 for notifying a user of the course list 431 of the notification screen 320 corresponding to the booting screen 300.

Referring to FIG. 15, in an embodiment of the present disclosure, the screen output unit 8 may be provided to output the course organization screen 322 for requesting the user to arrange the courses designated as the display group, and the controller 60 may be provided to release designation of the display group of the course having a use frequency of a reference frequency or less among the courses designated as the display group based on a manipulation signal generated in the course organization screen 322.

In detail, the controller 60 may control the screen output unit 8 to output the course organizing screen 322 when there is a course used to be less than a first reference frequency in the laundry treatment process P3 corresponding to the first reference number among the courses of the currently set display group.

The screen output unit 8 may output the course organization screen as one of the notification screen 320 under control of the controller 60 in the booting process P1. The course organizing screen 322 may include a notification guide area 3221 indicating that courses need to be organized, and a course organization selecting area 3222 for selecting whether the user organizes courses.

A phrase indicating that courses need to be organized may be displayed in the notification guide area 3221 of the course organizing screen 322. A specific phrase of the notification guide area 3221 may be variously determined.

The course organization selecting area 3222 of the course organizing screen 322 may display an item for instructing course organization and an item for cancelling the item. That is, an organization item and a cancel item may be displayed in the course organization selecting area 3222. Specific names of the organization item and the cancel item may vary, and various display methods may be used.

One of the organization item and the cancel item may be selected by a user. For example, the user may rotate the dial unit 56 on the course organizing screen 322 to position the selection indication in any one of the organization item and the cancel item, and may input a progress of the selection target by manipulating the multi-function button unit 91.

When the multi-function button unit 91 is manipulated in the course organization screen 322, the controller 60 may perform a process of releasing designation of the courses below the first reference frequency. When the multi-function button unit 91 is manipulated with respect to the cancel item, the course organization process may be canceled and the booting process P1 may be performed.

The course organizing screen 322 may include the function display area 405 by activating the multi-function button unit 91. The function display area 405 of the course organizing screen 322 may display a selection function of the current selection target. FIG. 15 shows the phrase "confirmation" in the function display area 405 according to an embodiment of the present disclosure, but a specific phrase may be variously determined.

Figure 16:
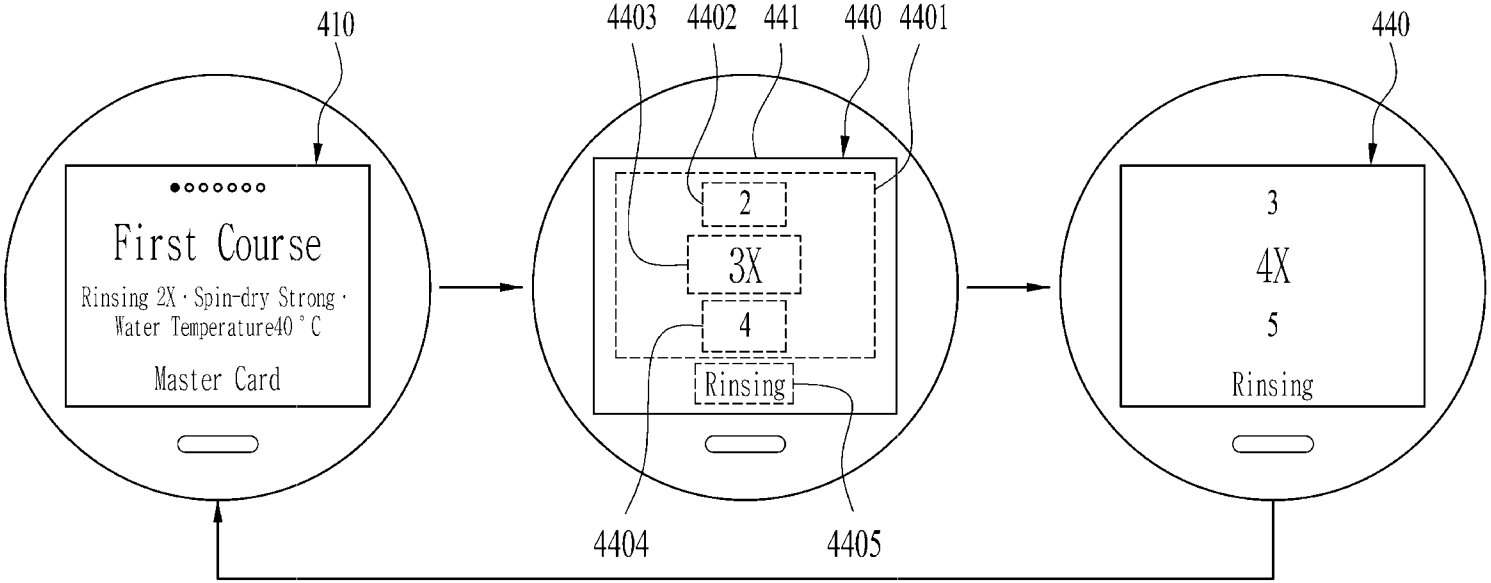
FIG. 16 is a diagram illustrating a first option screen output from a screen output unit according to an embodiment of the present disclosure.

FIG. 16 illustrates an option screen 440 output from the screen output unit 8 according to an embodiment of the present disclosure.

As described above, according to an embodiment of the present disclosure, an option button unit may be provided, and the option button unit may be provided in the cabinet 10 and manipulated by a user to adjust an option value for each of a plurality of courses.

The screen output unit 8 may be provided to output the course selection screen 410 configured to display one of the plurality of courses for treating clothes, the course selection screen 410 may be switched to the option screen 440 when the option button unit is manipulated, and an option value of the course displayed in the course selection screen 410 may be displayed in the option screen 440.

The option button unit may be provided to change an option setting value for the corresponding option. That is, when the user manipulates the option button unit, the option value corresponding to the option setting value of the corresponding option may be changed to another option value.

For example, when the option button unit is provided with respect to an option of the number of rinses, the option for the number of rinses may include a plurality of option values, such as one time, two times, and three times, and when the option button unit is manipulated in the case in which the option setting value of the option for the number of rinses is one time, the option setting value of the option for the number of rinses may be changed to two, three times, or the like corresponding to differential option values.

An option corresponding to the option button unit may be applied to each course. That is, the option button unit may be provided to change the option setting value of the corresponding option for each of the plurality of courses.

When the option button unit is manipulated in the course selection screen 410, the screen output unit 8 may output the option screen 440. That is, when the option button unit is manipulated, the course selection screen 410 may be switched to the option screen 440.

A plurality of option values for the corresponding option may be displayed in the option screen 440. The user may select any one of the plurality of option values from the option screen 440 and set the selected option value as an option setting value of the corresponding option.

For example, the user may output the option screen 440 by manipulating any one of the plurality of option button units while the course selection screen 410 is output on the screen output unit 8 in the course setting process P2.

The plurality of option values may be displayed in the option screen 440, and the user may set any one of the plurality of option values as an option selection value by using the dial unit 56, or may adjust the option setting value by repeatedly manipulating the option button unit on the option screen 440.

According to an embodiment of the present disclosure, when the option button unit is manipulated, the screen output unit 8 may output the option screen 440 configured to display a change in the option setting value with respect to the corresponding option, thereby providing convenience for option setting to the user.

In an embodiment of the present disclosure, the screen output unit 8 may be switched from the course selection screen 410 to the option screen 440 in the entire area of the display 84 on which the screen is output. Accordingly, a limited area of the display 84 may be utilized as much as possible, and a plurality of screens may be efficiently provided to the user.

In an embodiment of the present disclosure, the screen output unit 8 may be switched from the course selection screen 410 to the option screen 440 through a pop-up method. In an embodiment of the present disclosure, the pop-up method means that a new screen is displayed as if it pops out from the existing screen. According to the pop-up method, it may be understood as a new screen being layered on top of the existing screen.

According to an embodiment of the present disclosure, in the course setting process P2, the screen output unit 8 may be provided to output the course setting screen 400, the course setting screen 400 may include the course selection screen 410 and the option screen 440, and the option screen 440 may be output in a pop-up manner from the course selection screen 410.

Figure 17:
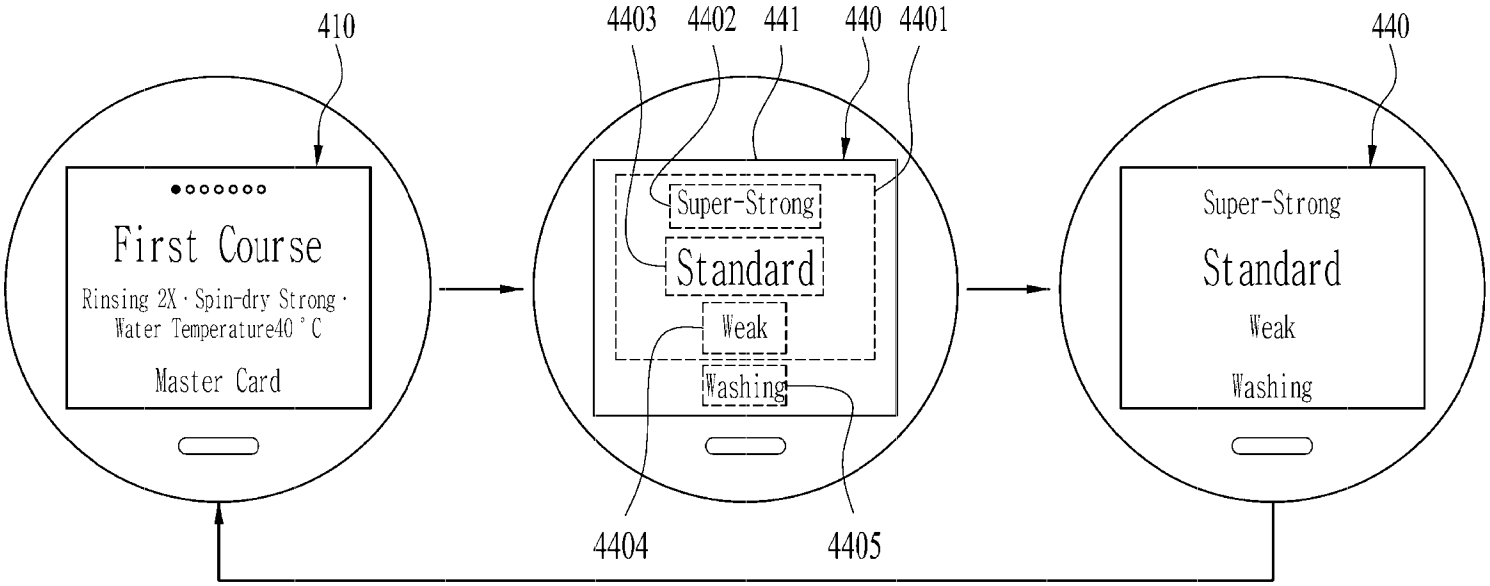
FIG. 17 is a diagram illustrating a second option screen output from a screen output unit according to an embodiment of the present disclosure.

FIG. 16 illustrates a state in which a screen of the screen output unit 8 is switched from the course selection screen 410 to a first option screen 441, and FIG. 17 illustrates a state in which a screen of the screen output unit 8 is switched from the course selection screen 410 to the second option screen 442.

Referring to FIGS. 16 and 17, in an embodiment of the present disclosure, the option button unit may include the first option button unit 212 configured to adjust a first option and the second option button unit 222 configured to adjust a second option, and when the first option button unit 212 is manipulated on the course selection screen 410, the screen output unit 8 may be switched to the first option screen 441 on which an option value of the first option is displayed, and when the second option button unit 222 is manipulated, the second option button unit 222 may be switched to the second option screen 442 on which an option value of the second option is displayed.

That is, in an embodiment of the present disclosure, the screen output unit 8 may output different screens for each option. When the first option button unit 212 is manipulated, the screen output unit 8 may output the first option screen 441 on which the option value of the first option is displayed, and when the second option button unit 222 is manipulated, the screen output unit 8 may output the second option screen 442.

FIG. 16 illustrates a state in which a rinsing number option screen 440 is output as the first option screen 441, and FIG. 17 illustrates a state in which a washing intensity option screen 440 is output as the second option screen 442.

However, in FIGS. 16 and 17, the rinsing number and the washing intensity indicated as the first option and the second option are only examples for description of the present disclosure, and the first option and the second option may be determined as options other than the rinsing number and the washing intensity.

In an embodiment of the present disclosure, the plurality of option buttons may be provided to adjust different options, the controller 60 may store a plurality of option values for each of a plurality of options, and any one of the plurality of option values may be set as an option setting value of the corresponding option.

The course selection screen 410 may include the option guide area 413 in which an option setting value of the currently displayed course is displayed, and the option screen 440 may include an option value display area 4401 in which the option setting value of the corresponding option and at least some of the plurality of option values are displayed together.

FIGS. 16 and 17 illustrate the option screen 440 in which a plurality of option values are displayed. As described above, the option button unit may be provided in a plural number, such as the first option button unit 212, the second option button unit 222, and the third option button unit 232.

The plurality of options may each have a plurality of option values. In FIG. 16, option values of one, two, and three times are displayed in the rinsing number option corresponding to the first option. In FIG. 17, option values such as strong, standard, and weak are displayed in the washing intensity option corresponding to the second option.

That is, in an embodiment of the present disclosure, the option value may be configured in various types such as numbers representing the number of times as well as a character type indicating intensity.

However, this is merely an example for explanation of an embodiment of the present disclosure, and the first option and the second option shown in FIGS. 16 and 17 are not necessarily limited thereto, and each option value of the first option and the second option is not limited thereto.

Each option may store any one of a plurality of option values as an option setting value. That is, any one course may adjust a plurality of options, the plurality of options may each have a plurality of option values, and each option may be stored as an option setting value and applied to the corresponding course.

Even if the user does not check the option screen 440, the course selection screen 410 may include the option guide area 413 to check option setting value information for each option in the currently displayed course.

That is, the course selection screen 410 is provided with the option guide area 413 in which option setting values of the plurality of options are displayed, and accordingly, the user may conveniently check each option setting value of the current course through the option guide area 413.

However, the option screen 440 may include the option value display area 4401 in which the option setting value of the corresponding option and at least some of the remaining option values are displayed together with the option setting value. Through the option value display area 4401, the user may conveniently confirm existence of an option value desired by the user on the option screen 440 and change the option setting value.

The current option setting value in the option value display area 4401 may be displayed differently from the remaining option values. FIGS. 16 and 17 illustrate a state in which the current option setting value is displayed in a size larger than the remaining option values and displayed with different color and brightness therefrom in the option value display area 4401. However, a method of distinguishing and displaying the option setting value may be various.

According to an embodiment of the present disclosure, the option setting value of each option is intuitively and simply notified to the user through the option guide area 413 in the course selection screen 410, and the option value other than the option setting value is displayed together on the option screen 440, and thus the user may conveniently recognize an option setting value currently desired by the user.

In an embodiment of the present disclosure, the option screen 440 may further include an option name display area 4405 together with the option value display area 4401. As described above, according to an embodiment of the present disclosure, the option screen 440 may include a plurality of option screens 440 such as the first option screen 441 and the second option screen 442, and accordingly, the option name display area 4405 may be provided on the option screen 440 to display the currently changed type of option to the user.

FIG. 16 illustrates a state in which a word "rinsing" is displayed in the option name display area 4405 of the first option screen 441 to indicate that the current option is an option for the number of rinses and illustrates a state in which a word "washing" is displayed in the option name display area 4405 of the second option screen 442 to indicate that the current option is an option for washing intensity.

However, the first option and the second option are not necessarily limited to the option for the number of rinses and the option for washing intensity, and further, specific phrases of the option name display area 4405 configured to indicate the option for the number of rinses and the option for washing intensity may also be variously determined.

In an embodiment of the present disclosure, the screen output unit 8 may display any one of the plurality of option values as an option setting value on the option screen 440, and when the option button unit is manipulated, the screen output unit 8 may display the other one of the plurality of option values as the option setting value.

For example, the user may manipulate the dial unit 56 to change the option setting value to another option value or repeatedly manipulate the option button unit to change the option setting value to another option value.

In an embodiment of the present disclosure, the screen output unit 8 may sequentially display at least some of the plurality of option values on the option screen 440, and when the option button unit is manipulated, an option value corresponding to a next order of the current option setting value may be changed to the option setting value and displayed.

A plurality of option values for the respective plurality of options may be pre-stored in the controller 60, and at least some of the plurality of option values for a corresponding option may be displayed in the option screen 440.

That is, in the option value display area 4401 of the option screen 440, the number of simultaneously displayed option values may be predefined, and when the number of option values of the corresponding option exceeds the number of option values simultaneously displayed in the option value area, the option value display area 4401 may display an option value of a previous order and option values of a subsequent order on the option value display area 4401 based on the option value corresponding to the current option setting value.

FIGS. 16 and 17 illustrate a state in which an option value corresponding to a previous order of an option value and an option value corresponding to a subsequent order, which are stored as an option setting value, are displayed together the option value display area 4401. However, the number of option values simultaneously displayed in the option value display area 4401 may vary as necessary.

The user may manipulate the option button unit on the option screen 440 to change a current option value of the option setting value to another option value. That is, when the option signal of the option button unit is input in a state in which the option screen 440 is output on the screen output unit 8, the controller 60 may change and set the option value corresponding to the next order of the option value corresponding to the current option setting value to an option setting value.

The user may set a desired option value among a plurality of option values as the option setting value by repeating an input process of the option button unit on the option screen 440.

When the option button unit is manipulated in the option screen 440, the screen output unit 8 may display the plurality of option values through a moving motion, and the remaining areas except for the plurality of option values may be equally maintained.

That is, only display of the option value display area 4401 of the option screen 440 may be changed in a state in which there is no change in the remaining area except for the option value display area 4401 operated by the option button unit. That is, according to an embodiment of the present disclosure, even if the option button unit is repeatedly manipulated, only the change of the option value is output without unnecessary screen change, thereby minimizing unnecessary screen change and effectively transmitting option value information to the user.

Each option value may be displayed in the option value display area 4401 through a moving motion. That is, each option value of the option value display area 4401 may be displayed to move together like animation when the option button unit is manipulated. FIGS. 16 and 17 illustrate a state in which the option button unit is input on the option screen 440 to change an option setting value, according to an embodiment of the present disclosure.

The option screen 440 may include the option setting value display area 4403 in which a current option setting value is displayed, and may further include a previous order display area 4402 located at one side of the option setting value display area 4403 to display a previous order option value of the current option setting value, and a next order display area 4404 located at the other side of the option setting value display area 4403 to display a next order option value of the current option setting value.

When the option button unit is manipulated in the option screen 440, the option value of the option setting value display area 4403 is moved to the previous order display area 4402 and displayed, and the option value of the next order display area 4404 may be moved to the option setting value display area 4403 and displayed.

In detail, according to an embodiment, the option value display area 4401 may include the option setting value display area 4403, the previous order display area 4402, and the next order display area 411. An option value set as a current option setting value may be displayed in the option setting value display area 4403, and an option value corresponding to a previous order of the option value displayed in the option setting value display area 4403 may be displayed in the previous order display area 4402, and an option value corresponding to a next order of the option values displayed in the option setting value display area 4403 may be displayed in the next order display area 4404.

That is, according to an embodiment of the present disclosure, the option value corresponding to the option setting value is displayed in the option setting value display area 4403 and thus the user may easily recognize the current option setting value, and the previous order display area 4402 and the next order display area 4404 are disposed on one side and the other side of the option setting value display area 4403, respectively, and thus the user may intuitively recognize the order of the option values and easily recognize a change of the option setting value according to manipulation of the option button unit.

FIGS. 16 and 17 illustrate the previous order display area 4402, the option setting value display area 4403, and the next order display area 4404 that are arranged side by side in a vertical direction, according to an embodiment of the present disclosure.

FIGS. 16 and 17 illustrate a result of changing an option setting value as an option button unit is input on the option screen 440. As described above, when the option button unit is manipulated, each option value of the option value display area 4401 may output a screen of which the position is changed through a moving motion.

According to an embodiment of the present disclosure, when the option button unit is manipulated, an option value located in the next order display area 4404 is moved to the option setting value display area 4403, and an option value located in the option setting value display area 4403 may be moved to the previous order display area 4402. An option value that is not displayed in the option value display area 4401 may be newly displayed in the next order display area 4404.

When the dial unit 56 is rotated in one direction on the option screen 440, the option value of the option setting value display area 4403 may be moved to the previous order display area 4402 and displayed, and when the dial unit 56 is rotated in the other direction, the option value of the option setting value display area 4403 may be moved to the next order display area 4404 to be displayed.

That is, according to an embodiment of the present disclosure, the option button unit needs to be input on the option screen 440 to change the option setting value, the dial unit 56 needs to be rotated to change the option setting value, or one of the option button unit and the dial unit 56 needs to be manipulated to change the option setting value. Determination of a manipulation method in the option screen 440 may be variously determined as necessary.

The screen output unit 8 may return to the course selection screen 410 from the option screen 440 when a manipulation signal of the option button unit is not generated during the option setting time preset in the controller 60 on the option screen 440.

As described above, the option screen 440 may be output in a pop-up form from the course selection screen 410, when the option screen 440 is terminated, the course selection screen 410 may be output again on the display 84 of the screen output unit 8, and in this case, the option setting value adjusted through the option screen 440 may be displayed in the option guide area 413 of the course selection screen 410.

The controller 60 may pre-store an option setting time for terminating the option screen 440. When the manipulation signal of the option button unit is not generated during the option setting time after the option screen 440 is output on the screen output unit 8, the controller 60 may determine that there is no option setting intention of the user.

That is, when the manipulation signal by the user is not generated during the option setting time in the option screen 440, the controller 60 may control the screen output unit 8 to return to the course selection screen 410 from the option screen 440 to terminate the option setting process.

According to an embodiment of the present disclosure, as described above, the option button unit may correspond to a part of the option unit 200, and the option unit 200 may further include an option display unit constituting an option adjuster together with the option button unit.

The option display unit may be provided to display the option setting value, and the screen output unit 8 may display the option setting value together with the option display unit on the option screen 440.

That is, according to an embodiment of the present disclosure, the option display unit displays a change of the option setting value to the user through a change in the light emitting characteristic of the light emitting unit 205, and also visually displays a change of the option setting value through the option screen 440 even in the screen output unit 8, thereby effectively improving use convenience.

The option display unit may include a plurality of light emitting units 205 as described above, the plurality of light emitting units 205 may correspond to different option values for the options, and the light emitting unit 205 corresponding to a currently set option setting value may emit light.

The plurality of light emitting units 205 may be arranged in parallel from the option button unit in one direction. The user may intuitively recognize a level of the current option setting value by displaying the current option setting value through the light emitting unit 205 aligned in a line from the option button unit.

Figure 18:
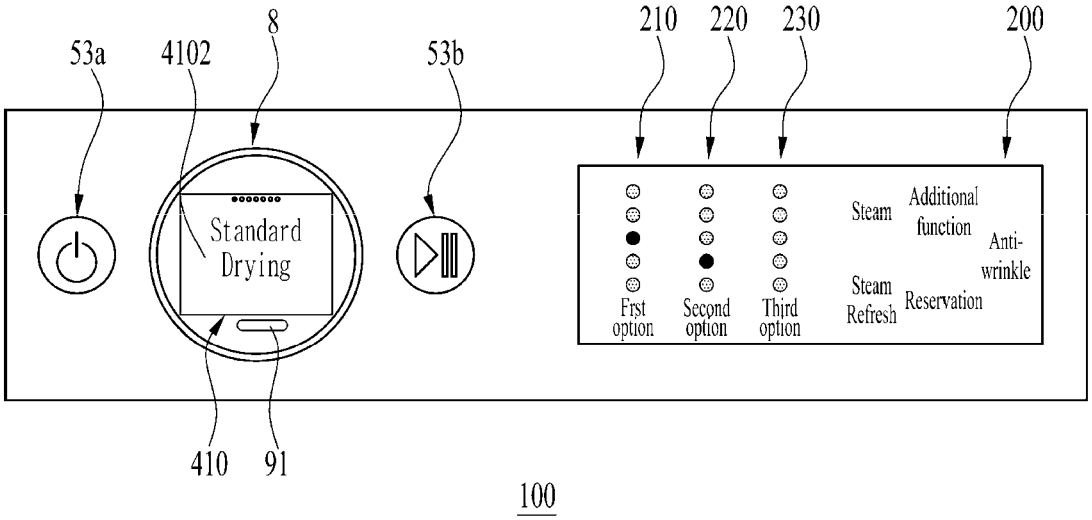
FIG. 18 is a diagram illustrating a control panel in which a standard drying course is displayed on a screen output unit according to an embodiment of the present disclosure.
Figure 19:
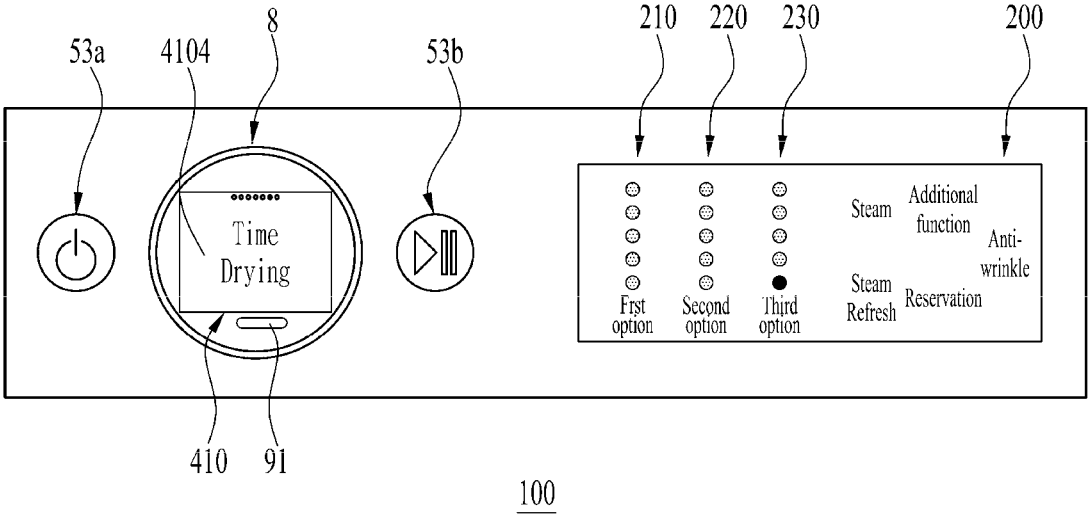
FIG. 19 is a diagram illustrating a control panel in a state in which a time drying course is displayed on a screen output unit according to an embodiment of the present disclosure.

FIG. 18 illustrates the control panel 100 on which one course is displayed in the course selection screen 410, and FIG. 19 illustrates the control panel 100 on which another course is displayed in the course selection screen 410.

Referring to FIGS. 18 and 19, as described above, in an embodiment of the present disclosure, a plurality of option adjusters including an option button unit and an option display unit may be provided to correspond to a plurality of options, options to be adjusted with respect to each of a plurality of courses may be preset in the controller 60, and the plurality of option adjusters may be configured to emit light when each of the plurality of option adjusters corresponds to an adjustable option in a course currently displayed in the course selection screen 410 to guide whether or not the option is adjustable to the user.

FIGS. 18 and 19 illustrate an option unit 200 including the first option adjuster 210, the second option adjuster 220, and the third option adjuster 230 according to an embodiment of the present disclosure. FIG. 18 illustrates a state in which the first option adjuster 210 and the second option adjuster 220 emit light and the third option adjuster 230 is turned off, and FIG. 19 illustrates a state in which the first option adjuster 210 and the second option adjuster 220 are turned off and the third option adjuster 230 emits light.

In FIG. 18, the controller 60 controls the option unit 200 in such a way that the first option adjuster 210 and the second option adjuster 220 emit light as the first option and the second option are adjustable with respect to the course displayed in the screen output unit 8.

In FIG. 19, the controller 60 may control the option unit 200 in such a way that the first option adjuster 210 and the second option adjuster 220 are turned off and the third option adjuster 230 emits light as the first option and the second option are not adjustable and the third option is adjustable with respect to the course displayed in the screen output unit 8.

As described above, in an embodiment of the present disclosure, an option group to be set for each course may be preset in the controller 60, and only an option adjuster corresponding to adjustable options with respect to the course displayed in the course selection screen 410 may emit light, thereby effectively improving user convenience.

In other words, as described above, in an embodiment of the present disclosure, the drum 30, the screen output unit 8, and the option adjuster may be provided, and the screen output unit 8 may be provided to output the course selection screen 410 selected by a user by displaying any one of a plurality of courses for treating clothes.

The plurality of option adjusters may be provided to emit light, respectively, and may be provided to emit light when a corresponding option adjuster corresponds to an adjustable option with respect to the course displayed in the course selection screen 410.

In an embodiment of the present disclosure, whether each option is adjustable for each of the plurality of courses may be pre-stored, and the controller 60 may control the plurality of option adjusters in such a way that an option adjuster corresponding to an adjustable option with respect to the course displayed in the course selection screen 410 among the plurality of option adjusters emits light and the remaining option adjusters do not emit light.

In an embodiment of the present disclosure, the manipulator may be provided in the cabinet 10 and manipulated by the user to generate a manipulation signal, and the screen output unit 8 may change the course displayed in the course selection screen 410 based on the manipulation signal.

Each of the plurality of option adjusters may include an option button unit that is manipulated by the user to adjust a corresponding option and an option display unit in which an option setting value of an option is displayed.

The option display unit may include the plurality of light emitting units 205, the plurality of light emitting units 205 may correspond to a plurality of option values corresponding to each option, and the light emitting unit 205 corresponding to a current option setting value for a corresponding option from among the plurality of light emitting units 205 may emit light to provide option setting value information to a user.

The option button unit and the option display unit may be provided to emit light, and the plurality of option adjusters may emit light together with the option button unit and the option display unit when the option adjuster corresponds to an adjustable option in the course displayed in the course selection screen 410.

When any one of the plurality of option adjusters is manipulated by the user on the course selection screen 410, the screen output unit 8 may be provided to output the option screen 440 configured to display an option value of a corresponding option.

For example, when the first option button unit 212 of the first option adjuster 210 is manipulated, the screen output unit 8 may output the first option screen 441, and when the second option button unit 222 of the second option adjuster 220 is manipulated, the screen output unit 8 may output the second option screen 442.

According to an embodiment of the present disclosure, an air supply unit may be further provided. The air supply unit may be provided inside the cabinet 10 to supply air for drying clothes into the drum 30.

The air supply unit may be provided in any one of an air circulation type in which air is circulated inside the cabinet 10 or an exhaust type in which external air is introduced into the cabinet 10 and then discharged again, and clothes inside the drum 30 may be dried by air supplied through the air supply unit.

That is, in an embodiment of the present disclosure, the air supply unit may be provided to include a drying course of drying clothes. According to an embodiment of the present disclosure, the tub 20 and the air supply unit may be provided together to perform both a washing process and a drying process, or the tub 20 may be excluded and the air supply unit may be provided to perform the drying process.

According to an embodiment of the present disclosure, the air supply unit may be provided, and the controller 60 may include a plurality of courses for drying clothes. That is, in an embodiment of the present disclosure, the plurality of courses for treating clothes may include two or more drying courses for drying clothes. The user may select any one of the plurality of drying courses and perform a laundry drying process according to convenience.

FIG. 18 illustrates the screen output unit 8 on which the standard drying course 4102 is displayed in the course selection screen 410 according to an embodiment of the present disclosure. In an embodiment of the present disclosure, the plurality of courses includes the standard drying course 4102 for drying the clothes, and the plurality of option adjusters include a time option unit 200 configured to set a time for each course, and the time option unit 200 may not emit light in a state in which the standard drying course 4102 is displayed in the course selection screen 410.

The standard drying course 4102 may preset time distribution in consideration of efficiency of a heating process or a drying process of air for drying clothes. For example, in a drying method using a heat pump, a time element may be important in a heating process of a fluid in a fluid circulation system including the heat pump or a heat pump operation strategy for the same.

Even if the drying method using the heater is performed, the heating process of air through the heater and a temporal side for drying clothes with air passing through the heater may be important for the overall drying efficiency and the drying result.

Accordingly, according to an embodiment of the present disclosure, the standard drying course 4102 in which the user is not capable of arbitrarily manipulating a drying time may be provided, and the time option unit 200 configured to adjust a time option may be deactivated in the standard drying course 4102.

In FIG. 18, the third option adjuster 230 may correspond to the time option unit 200, and thus, in a state in which the display drying course is displayed in the course selection screen 410, the third option adjuster 230 corresponding to the time option unit 200 may be turned off in a state in which the first option adjuster 210 and the second option adjuster 220 emit light, thereby intuitively notifying the user that any setting of time is impossible.

According to an embodiment of the present disclosure, the controller 60 may store the plurality of courses and set the time option not to be adjustable through the time option unit 200 with respect to the standard course, and the controller 60 may control the option unit 200 to prevent the time option unit 200 from emitting light when the standard drying course 4102 is displayed in the course selection screen 410.

FIG. 19 illustrates the screen output unit 8 in which a time drying course 4104 is displayed in the course selection screen 410 according to an embodiment of the present disclosure. Referring to FIG. 19, in an embodiment of the present disclosure, the plurality of courses may further include the time drying course 4104 for adjusting a time option through the time option unit 200, and the time option unit 200 may be configured to emit light in a state in which the time drying course 4104 is displayed in the course selection screen 410.

According to an embodiment of the present disclosure, as described above, the standard drying course 4102 in which a time option is not capable of being arbitrarily manipulated by the user may be provided. However, the user may require an additional drying process or only a drying process corresponding to a relatively short time according to circumstances.

According to an embodiment of the present disclosure, to effectively satisfy various demands of the user, the time drying course 4104 as well as the standard drying course 4102 may be preset in the controller 60.

Unlike the standard drying course 4102, the time drying course 4104 may be set in such a way that the user is capable of directly adjusting a drying time. For example, the user may perform an additional drying process for a desired time through the time drying course 4104 in a state in which the standard drying course 4102 is already performed, and may perform a desired level of drying process within a short time through the time drying course 4104 in a state in which the amount of moisture contained in clothes is relatively low.

When the time drying course 4104 is displayed in the course selection screen 410 of the screen output unit 8, the third option adjuster 230 corresponding to the time option unit 200 may emit light differently from the standard drying course 4102 to visually inform the user that the time option is adjustable.

In other words, in an embodiment of the present disclosure, the controller 60 may be set not to adjust the time option through the time option unit 200 with respect to the standard drying course 4102, and the time drying course 4104 may be set to adjust the time option through the time option unit 200.

Figure 20:
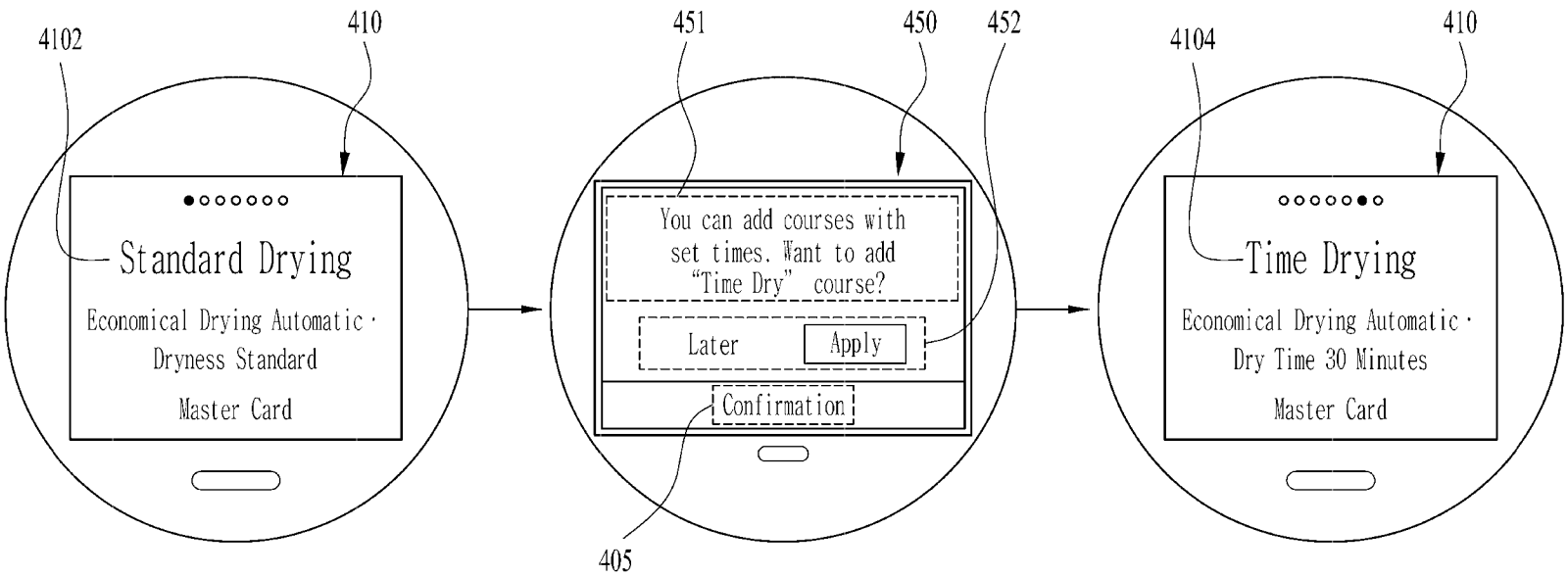
FIG. 20 is a diagram illustrating a time drying guide screen output from a screen output unit according to an embodiment of the present disclosure.

FIG. 20 illustrates a state in which a time drying guide screen 450 configured to guide the time drying course 4104 to a user is output on the screen output unit 8 according to an embodiment of the present disclosure.

Referring to FIG. 20, in an embodiment of the present disclosure, when the time option unit 200 is manipulated by the user in a state in which the standard drying course 4102 is displayed in the course selection screen 410, the screen output unit 8 may be provided to output the time drying guide screen 450 configured to guide use of the time drying course 4104 instead of the standard drying course 4102 to the user.

As described above, in an embodiment of the present disclosure, the standard drying course 4102 may not control a separate time by the user, and the time drying course 4104 may be provided to adjust a separate time by the user.

However, the user may not recognize whether a time option for each of the standard drying course 4102 and the time drying course 4104 that are set in the controller 60 is adjustable, and further, the user may manipulate the third option button unit 232 to adjust a time even if the third option adjuster 230, which is described as corresponding to the time option unit 200 for convenience of description, is turned off in the standard drying course 4102.

Therefore, according to an embodiment of the present disclosure, in a state in which the course selection screen 410 is output on the screen output unit 8 and the standard drying course 4102 is displayed in the course selection screen 410, when the user manipulates the third option button unit 232 of the third option adjuster 230 corresponding to the time option unit 200, the controller 60 may control the screen output unit 8 to output the time drying guide screen 450 configured to propose execution of the time drying course 4104 instead of or in addition to the standard drying course 4102.

In an embodiment of the present disclosure, a moving item for displaying the time drying course 4104 may be displayed in the time drying guide screen 450, and when the moving item is selected based on the manipulation signal, the screen output unit 8 may change the course displayed in the course selection screen 410 from the standard drying course 4102 to the time drying course 4104 and display the time drying course 4104.

Referring to FIG. 20, in an embodiment of the present disclosure, the time drying guide screen 450 may include a course guiding area 451 and a course switching selection area 452.

The course guidance area 451 may display a phrase for guiding a change from the standard drying course 4102 to the time drying course 4104 for time adjustment. The phrase displayed in FIG. 20 is an example for describing an embodiment of the present disclosure, and a specific phrase may be variously determined.

The course switching selection area 452 may include a moving item for consent and command to change from the standard drying course 4102 to the time drying course 4104, and a cancel item for cancelling a course change and maintaining display of the standard drying course 4102.

In FIG. 20, to indicate a selection result of each item to the user, a phrase "apply" is displayed in the moving item, and a phrase "later" is displayed in the cancel item.

However, the phrase displayed in the moving item and the cancel item in FIG. 20 is for an example of the present disclosure, and thus may be variously changed as necessary.

The time drying guide screen 450 may further include the function display area 405. That is, a function of the multi-function button unit 91 may be activated in the time drying guide screen 450, and the multi-function button unit 91 may have a function of selecting an item in which a selection indication is located among the moving item and the cancel item. The function display area 405 may display a phrase indicating that selection of a corresponding item is performed during manipulation of the multi-function button unit 91, such as "confirmation".

In a state in which the selection indication is located on a moving item in the time drying guide screen 450 and the moving item is a selection target, when the multi-function button unit 91 is manipulated, the controller 60 may control the screen output unit 8 to output the course selection screen 410 on which the time drying course 4104 is displayed, and in a state in which the cancel item is the selection target, when the multi-function button unit 91 is manipulated, the controller 60 may control the screen output unit 8 to return to the course selection screen 410 on which the existing standard drying course 4102 is displayed.

When the course selection screen 410 on which the time drying course 4104 is displayed is output on the screen output unit 8 through the time drying guide screen 450, if execution of the time drying course 4104 is input according to the manipulation signal of the execution button unit 53*b*, the controller 60 may perform only the time drying course 4104 instead of the existing standard drying course 4102 or may add the time drying course 4104 as an option to the existing standard drying course 4102 and perform the same.

Figure 21:
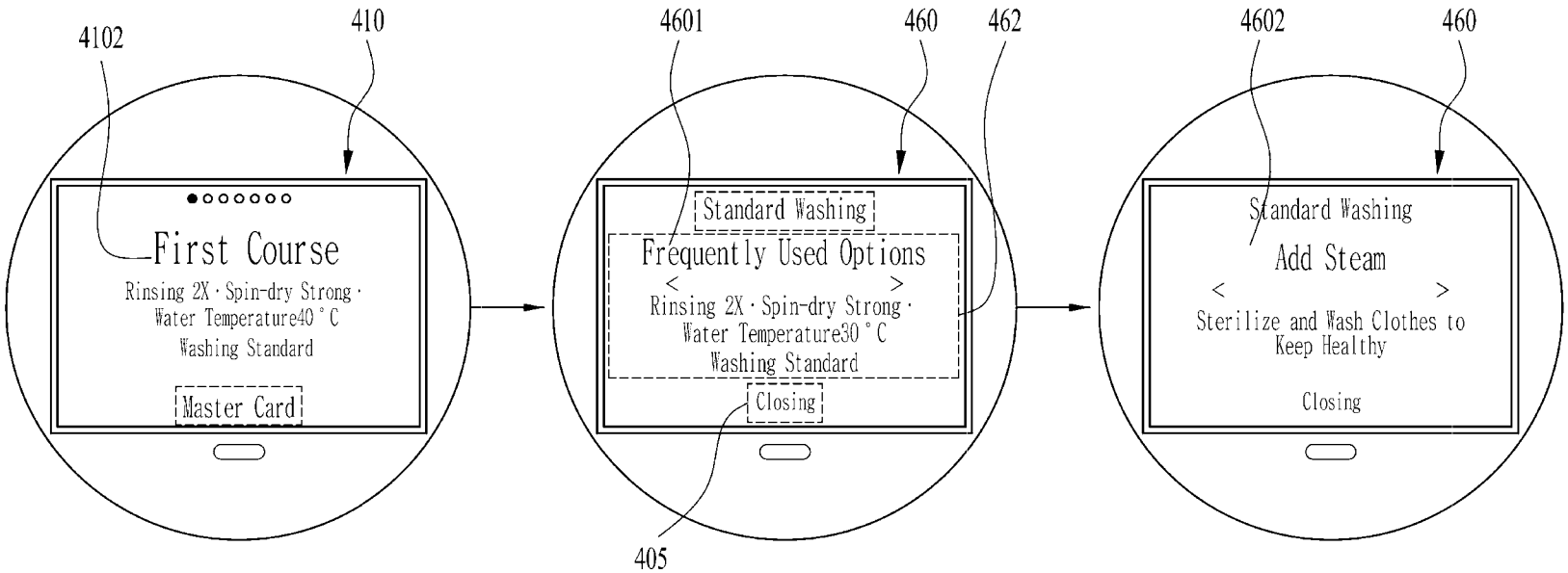
FIG. 21 is a diagram illustrating an option recommendation screen output from a screen output unit according to an embodiment of the present disclosure.

FIG. 21 illustrates the option recommendation screen 460 that is converted and output from the course selection screen 410 according to an embodiment of the present disclosure. The option recommendation screen 460 may correspond to a part of the course setting screen 400 output from the screen output unit 8 in the course setting process P2.

As described above, according to an embodiment of the present disclosure, the cabinet 10, the drum 30, the manipulator, the screen output unit 8, and the controller 60 may be provided. The controller 60 may be signally connected to the manipulator and the screen output unit 8, may pre-store a plurality of courses for treating clothes, and may adjust option setting values for a plurality of options in each course based on the manipulation signal.

The screen output unit 8 may be provided to output the course selection screen 410 selected by the user by displaying any one of the plurality of courses based on the manipulation signal, and the controller 60 may store a preset option combination for each option setting value for the plurality of options with respect to the course displayed in the course selection screen 410, and propose the option combination to the user through the screen output unit 8.

As described above, each of the plurality of courses may be provided in such a way that the plurality of options are adjustable. Each of the plurality of options may have an initial option setting value for each course, and if there is no separate option adjustment by the user, the corresponding course may be performed based on the initial option setting value.

When the option setting value set by the user is present greater than or equal to a preset cumulative number, the controller 60 may store the option setting value set by the user for the plurality of options in an option combination, and propose the option setting value to the user when a subsequent course is selected.

The controller 60 may pre-store option setting values recommended to the user or expected to be necessary for the plurality of options in executing the course, and the controller 60 may pre-store an option combination in which option setting values to be recommended or expected to be necessary for the user for the plurality of options are combined.

That is, the controller 60 may store the option setting value collected by the user or recommended to the user as the option combination, and propose the option combination to the user in the course selection process of the user.

In an embodiment of the present disclosure, the controller 60 may store the plurality of option combinations, and the plurality of option combinations may be set to have different option setting values among the plurality of options.

That is, in an embodiment of the present disclosure, any one option combination may include respective option setting values for a plurality of options, and a plurality of different option combinations may be stored in the controller 60. The plurality of option combinations may be set in such a way that at least one option setting value for at least one option is different from each other.

According to an embodiment of the present disclosure, an option combination may be recommended to the user in a course selection process to improve use convenience, and a plurality of option combinations may be provided to provide various option combinations to the user.

A method in which the plurality of option combinations are proposed to the user through the option recommendation screen 460 may be the same as or similar to the method in which the plurality of courses are provided to the user on the course selection screen 410.

For example, any one option combination of the plurality of option combinations may be selectively displayed in the option recommendation screen 460, and the user may rotate the dial unit 56 to sequentially display the plurality of option combinations on the screen.

With reference to FIG. 21, a method of proposing an option combination in an embodiment of the present disclosure will be described below.

In a state in which the course selection screen 410 is output on the screen output unit 8, the multi-function button unit 91 may have an option recommendation function. That is, when the manipulation signal of the multi-function button unit 91 is generated in a state in which the course selection screen 410 is output, the controller 60 may control the screen output unit 8 to output the option recommendation screen 460 for recommending the option combination to the user.

The course selection screen 410 may include the function display area 405 configured to display a function of the multi-function button unit 91, and a phrase indicating an option recommendation function in which an option combination is recommended when the multi-function button unit 91 is manipulated may be displayed in the function display area 405.

In FIG. 21, the function display area 405 may display an option of an option recommendation function called a "master card", and the phrase referring to the option recommendation function may be variously determined as necessary.

When the multi-function button unit 91 is manipulated in the course selection screen 410, the screen output on an area of the display 84 of the screen output unit 8 may be switched from the course selection screen 410 to the option recommendation screen 460.

The option recommendation screen 460 may include the course display area 461, the option combination area 462, and the function display area 405.

A phrase indicating the course displayed in the course selection screen 410 may be displayed in the course display area 461. For example, a name of the course may be displayed in the course display area 461. The user may conveniently check a target course of the option combination currently recommended through the course display area 461.

A plurality of option combinations may be alternatively displayed in the option combination area 462. A method of displaying a plurality of option combinations in the option combination area 462 is similar to a method in which a plurality of courses are displayed in the course selection screen 410.

That is, any one of a plurality of option combinations may be displayed in the option combination area 462, and the user may manipulate the dial unit 56 and the like to change an option combination displayed in the option combination area 462 to another option combination.

FIG. 21 is a diagram illustrating a state in which a second option combination 4602 is displayed in the option combination area 462 according to manipulation of a manipulator of a user in a state in which a first option combination 4601 is displayed in the option combination area 462 of the option recommendation screen 460.

As will be described later, the controller 60 may preset an option combination group applicable for each course in the plurality of option combinations, and display only the option combination corresponding to the option combination group applicable to the course displayed in the course display area 461 in the option combination area 462 in the option recommendation screen 460.

Various information on the currently displayed option combination may be displayed in the option combination area 462. For example, an option setting value of each option included in a name of an option combination and a corresponding option combination may be displayed in the option combination area 462.

The option recommendation screen 460 may include the function display area 405 configured to display the function of the multi-function button unit 91 like the course selection screen 410. In the option recommendation screen 460, the multi-function button unit 91 may have a termination function for terminating the option recommendation screen 460, and a phrase indicating the termination function of the multi-function button unit 91 may be displayed in the function display area 405.

Although the phrase "closing" is displayed in the function display area 405 in FIG. 21, this is merely an example for describing the present disclosure, and the phrase indicating the termination function of the multi-function button unit 91 may vary as necessary.

FIG. 22 illustrates a table about whether a plurality of option combinations are applicable for each of a plurality of course, according to an embodiment of the present disclosure. The number of option combinations and the number of courses in the table of FIG. 22 are merely examples for convenience of description, and may be variously changed as necessary.

Referring to FIG. 22, in an embodiment of the present disclosure, the plurality of option combinations may be stored in the controller 60, option combinations applicable to each of the plurality of courses may be preset, and the screen output unit 8 may be controlled to display option combinations applicable to the course displayed in the course selection screen 410 among the plurality of option combinations.

As described above, in an embodiment of the present disclosure, the option unit 200 may include a plurality of option adjusters corresponding to a plurality of options, and may include additional option buttons for additional options other than options adjusted by the option adjuster. Each of the plurality of option adjusters may be set in the controller 60 not to change each course.

That is, in an embodiment of the present disclosure, there may be a case in which a plurality of option combinations are not applicable to some of the plurality of courses according to the respective option characteristics, and accordingly, the controller 60 may be preset for each course-specific application value for the plurality of option combinations similar to the table of FIG. 22.

Therefore, in an embodiment of the present disclosure, the controller 60 may store a plurality of option combinations to provide convenience to the user through various option setting values, but the plurality of courses may not be changed or apply a specific option due to each characteristic, and thus the controller 60 may recommend an optimal option combination for each course to the user, thereby improving user convenience.

In an embodiment of the present disclosure, when any one of a plurality of courses is displayed in the screen output unit 8, the controller 60 may propose optional combinations applicable to the one course to the user through the screen output unit 8.

Referring to FIG. 22, in an embodiment of the present disclosure, the controller 60 may not provide the option combination with respect to some of the plurality of courses. In FIG. 22, courses are indicated as examples in which there is no applicable option combination.

In other words, in an embodiment of the present disclosure, some of the plurality of courses may be set in such a way that the option combination is not applicable. In other words, options for some of the plurality of courses may be provided not to be changed.

For example, in an embodiment of the present disclosure, the plurality of courses may include a tub sterilization course for automatically washing the inside of the drum 30 by using steam, and the like, and the tub sterilization course may be set in such a way that the number of rinses, washing intensity, water temperature, and steam application are not arbitrarily adjusted because clothes are not directly treated.

There may be courses that are not changed with respect to a plurality of options included in the option combination for various reasons, in addition to the tub sterilization course, and accordingly, according to an embodiment of the present disclosure, the controller 60 may be set not to propose an option combination for some of the plurality of courses.

In an embodiment of the present disclosure, the plurality of option combinations may include a most frequent combination, and the controller 60 may store an option setting value set to be the same by the user in a laundry treatment cycle greater than or equal to a predefined reference number of times as the most frequent combination.

As described above, when the option setting value set by the user is applied to the predefined reference number or more to be performed in the laundry treatment process P3, the controller 60 may store each option setting value for the plurality of options as the most frequent combination corresponding to one of the plurality of option combinations and recommend the stored option setting value to the user.

FIG. 21 illustrates a combination recommendation screen in which a first combination option is displayed, and the first combination option may correspond to the most frequent combination.

In an embodiment of the present disclosure, the controller 60 may store, as the most frequent combination, an option setting value having the highest use frequency when there are a plurality of option setting values set to be the same in the laundry treatment cycle greater than or equal to the reference number of times.

As a time period of use of the laundry treatment apparatus 1 increases, the option setting value set by the user more than the reference number may increase, and when there are a plurality of option setting values set by the user for more than the reference number, the controller 60 may store the option setting value having the highest use frequency among the plurality of option setting values used for the reference number or more as the most frequent combination and recommend the stored option setting value to the user.

As described above, the screen output unit 8 may be switched to the option recommendation screen 460 configured to display the option combination on the course selection screen 410 based on the manipulation signal.

The option recommendation screen 460 may be provided in a pop-up form on the course selection screen 410, such as the option screen 440 described above, and the entire course selection screen 410 may be switched to the option recommendation screen 460.

As described above, the screen output unit 8 may alternatively display any one of the plurality of option combinations on the option recommendation screen 460, and the currently displayed option combination may be changed based on the manipulation signal of the manipulator.

The manipulator may include a multi-function button unit 91 provided on the screen output unit 8 and having a function that varies according to a screen output from the screen output unit 8, and the screen output unit 8 may be switched to the option recommendation screen 460 when the manipulation signal of the multi-function button unit 91 is generated on the course selection screen 410.

The course selection screen 410 may include the function display area 405 configured to display the function of the multi-function button unit 91, and the function display area 405 of the course selection screen 410 may display the function of entry into the option recommendation screen 460.

When a manipulation signal of the multi-function button unit 91 is generated in the option recommendation screen 460, the screen output unit 8 may return to the course selection screen 410 from the option recommendation screen 460. That is, as described above, the multi-function button unit 91 may have an option recommendation termination function in the option recommendation screen 460. Accordingly, the termination function of the option recommendation screen 460 may be displayed in the function display area 405 of the option recommendation screen 460.

In an embodiment of the present disclosure, when the execution button unit 53*b* configured to instruct execution of the laundry treatment process P3 is manipulated in a state in which one option combination is displayed in the option recommendation screen 460, the controller 60 may perform the laundry treatment process P3 by applying an option combination displayed in the option combination area 462 to the course displayed in the course display area 461 of the option recommendation screen 460.

In an embodiment of the present disclosure, option setting values of an option combination displayed in the option recommendation screen 460 may be simultaneously displayed in the option recommendation screen 460 and the option display unit.

When the option combination displayed in the option recommendation screen 460 is changed according to manipulation such as the dial unit 56, the option display unit may be provided to change and display the option setting value information in response to a change in the option combination.

Hereinafter, an option combination recommendation function according to an embodiment of the present disclosure will be described in terms of manipulation of a manipulator by a user as follows.

According to an embodiment of the present disclosure, the manipulator may be provided in the cabinet 10 and manipulated by the user to generate a manipulation signal, and the screen output unit 8 may be provided in the cabinet 10 to output a screen configured to provide information to the user.

The controller 60 may be signally connected to the manipulator and the screen output unit 8, may pre-store the plurality of courses for treating clothes, and an option setting value for a plurality of options in each course may be adjusted based on the manipulation signal.

The screen output unit 8 may be provided to output the course selection screen 410 selected by the user by displaying any one of the plurality of courses based on the manipulation signal, the controller 60 may store a preset option combination for each option setting value for the plurality of options with respect to the course displayed in the course selection screen 410, and the screen output unit 8 may be switched from the course selection screen 410 to the option recommendation screen 460 in which the option combination is displayed based on the manipulation signal on the course selection screen 410.

The manipulator may include the multi-function button unit 91. The multi-function button unit 91 may be provided in the screen output unit 8 and may vary a function according to a screen output on the screen output unit 8. When the manipulation signal of the multi-function button unit 91 is generated in the course selection screen 410, the screen output unit 8 may be switched to the option recommendation screen 460.

The course selection screen 410 includes the function display area 405 configured to display the function of the multi-function button unit 91, and the function display area 405 of the course selection screen 410 may display the function of entry into the option recommendation screen 460.

The screen output unit 8 may alternatively display any one of the plurality of courses in the course selection screen 410, and when the manipulation signal of the multi-function button unit 91 is generated, the screen output unit 8 may display an option combination of the course displayed in the course selection screen 410. That is, an option combination applicable to the corresponding course may be displayed in the option recommendation screen 460.

The execution button unit 53*b* may be provided in the cabinet 10 and may generate a course execution signal displayed in the course selection screen 410. That is, the controller 60 may determine the manipulation signal of the execution button unit 53*b* as an execution signal.

When the execution signal is generated, the controller 60 may be provided to apply the course displayed in the course selection screen 410 to the option combination displayed in the option recommendation screen 460.

When the manipulation signal of the multi-function button unit 91 is generated in the option recommendation screen 460, the screen output unit 8 may return to the course selection screen 410 from the option recommendation screen 460.

That is, when the manipulation signal of the multi-function button unit 91 is generated in the option recommendation screen 460, the controller 60 may control the screen output unit 8 to return a screen of an area of the display 84 from the option recommendation screen 460 to the course selection screen 410.

When the option recommendation screen 460 returns to the course selection screen 410 through the multi-function button unit 91, the controller 60 may control the screen output unit 8 to disregard the option combination recommended by the option recommendation screen 460 and output the course selection screen 410 to which the option setting value is applied entry into the option recommendation screen 460.

That is, when the manipulation signal of the multi-function button unit 91 is input from the option recommendation screen 460, the controller 60 may restore an option setting value of each option of the course displayed in the course selection screen 410 to an initial value.

In an embodiment of the present disclosure, when the option unit 200 is manipulated in the option recommendation screen 460, the screen output unit 8 may return to the course selection screen 410 from the option recommendation screen 460.

That is, the controller 60 may control the screen output unit 8 to output the course selection screen 410 again by receiving the manipulation signal of the option button unit or the additional option button unit of the option unit 200 in the option recommendation screen 460 in the same manner as the manipulation signal of the multi-function button unit 91.

As described above, the option unit 200 may further include a plurality of option display units configured to display respective option setting values of the plurality of options, and an option combination value of an option combination displayed in the option recommendation screen 460 may be simultaneously displayed in the option recommendation screen 460 and the option display unit.

The screen output unit 8 may alternatively display any one of option combinations applicable to the option recommendation screen 460, and an option combination displayed in the option recommendation screen 460 may be changed based on the manipulation signal.

The manipulator may include the dial unit 56 configured to be rotatable while surrounding the screen output unit 8, and the screen output unit 8 may change the course displayed in the course selection screen 410 when the dial unit 56 is rotated in the course selection screen 410, and the option combination displayed in the option recommendation screen 460 may be changed when the dial unit 56 is rotated on the option recommendation screen 460.

The laundry treatment apparatus 1 according to an embodiment of the present disclosure may include the cabinet 10, the drum 30, the manipulator, the screen output unit 8, and the controller 60, and the screen output unit 8 may be provided to display any one of the plurality of courses based on the manipulation signal to output the course selection screen 410 selected by the user, the controller 60 may store a preset option combination for each option setting value for the plurality of options with respect to the course displayed in the course selection screen 410, and the screen output unit 8 may be switched to the option recommendation screen 460 on which the option combination is displayed when the multi-function button unit 91 is manipulated in the course selection screen 410.

Although the present disclosure has been illustrated and described in connection with a specific embodiment, it would be obvious to a person skilled in the art that the present disclosure is to be variously modified and changed without departing from the technical spirit of the present disclosure provided by the claims below.

The invention claimed is:

1. A laundry treatment apparatus comprising:

a cabinet;

a drum rotatably provided in the cabinet and configured to accommodate clothes therein;

a controller configured to store a plurality of courses for treating the clothes and to control rotation of the drum to execute the plurality of courses;

an option button unit provided in the cabinet and configured to be manipulated by a user to adjust an option setting value for each of the plurality of courses; and a screen output unit provided in the cabinet and provided separately from the option button unit, the screen output unit being configured to output a screen that provides information to the user, wherein the screen output unit is configured to;

output a course selection screen that displays any one of the plurality of courses for treating the clothes, and switch to an option screen based on the option button unit being manipulated.

2. The laundry treatment apparatus of claim 1, wherein a plurality of option values for a course displayed in the course selection screen are displayed in the option screen.

3. The laundry treatment apparatus of claim 1, wherein the screen output unit is switched to the option screen from the course selection screen in an entire area of a display configured to output a screen.

4. The laundry treatment apparatus of claim 1, wherein the screen output unit is switched to the option screen from the course selection screen through a pop-up method.

5. The laundry treatment apparatus of claim 1, wherein the option button unit includes a first option button unit configured to adjust a first option and a second option button unit configured to adjust a second option, and wherein the screen output unit is configured to:

switch to a first option screen that displays an option value of the first option based on the first option button unit being manipulated in the course selection screen, and switch to a second option screen that displays an option value of the second option based on the second option button unit being manipulated.

6. The laundry treatment apparatus of claim 1, wherein a plurality of option button units are provided and configured to have different options, wherein the controller stores a plurality of option values for each of a plurality of options, wherein any one of the plurality of option values is set to an option setting value of a corresponding option, wherein the course selection screen includes an option guide area configured to display an option setting value of a currently displayed course, and wherein the option screen includes an option value display area in which the option setting value of the corresponding option and at least some of the plurality of option values are displayed together.

7. The laundry treatment apparatus of claim 6, wherein the screen output unit is configured to display any one of the plurality of option values as an option setting value in the option screen, and wherein, based on the option button unit being manipulated, another one instead of the any one of the plurality of option values is displayed as the option setting value.

8. The laundry treatment apparatus of claim 7, wherein the screen output unit is configured to sequentially list and display at least some of the plurality of option values in the option screen, and wherein, based on the option button unit being manipulated, an option value corresponding to a next order of a current option setting value is changed to the option setting value and is displayed.

9. The laundry treatment apparatus of claim 8, wherein, based on the option button unit being manipulated in the option screen, the screen output unit displays the plurality of option values through a moving motion and equally maintains a remaining area except for the plurality of option values.

10. The laundry treatment apparatus of claim 9, wherein the option screen includes:

an option setting value display area in which a current option setting value is displayed;

a previous order display area positioned at one side of the option setting value display area and configured to display a previous order option value of the current option setting value; and a next order display area positioned at another side of the option setting value display area and configured to display a next order option value of the current option setting value.

11. The laundry treatment apparatus of claim 10, wherein the screen output unit is configured to, based on the option button unit being manipulated on the option screen, (i) move an option value of the option setting value display area to the previous order display area to display the option value and (ii) move an option value of the next order display area to the option setting value display area to display the option value.

12. The laundry treatment apparatus of claim 11, further comprising a dial unit surrounding the screen output unit and provided to be rotatable, and wherein the screen output unit is configured to:

based on the dial unit being rotated in one direction in the option screen, the screen output unit, move the option value of the option setting value display area to the previous order display area to display the option value, and based on the dial unit being rotated in another direction, move the option value of the option setting value display area to the next order display area to display the option value.

13. The laundry treatment apparatus of claim 1, wherein the screen output unit is configured to, based on a manipulation signal of the option button unit not being generated in an option setting time preset in the controller in the option screen, return to the course selection screen from the option screen.

14. The laundry treatment apparatus of claim 1, further comprising an option unit including the option button unit, wherein the option unit further includes an option display unit configured to display the option setting value, and wherein the screen output unit is configured to display the option setting value with the option display unit in the option screen.

15. The laundry treatment apparatus of claim 14, wherein the option display unit includes a plurality of light emitting units, and wherein the plurality of light emitting units correspond to different option values for an option, and wherein a lighting emitting unit, among the plurality of light emitting units, corresponding to a currently set option setting value is configured to emit light.

16. The laundry treatment apparatus of claim 15, wherein the plurality of light emitting units are arranged in parallel with each other in one direction from the option button unit.

17. The laundry treatment apparatus of claim 14, wherein the option unit includes an option adjuster including the option display unit and the option button unit, wherein the option adjuster is one of a plurality of option adjusters that are provided to correspond to different options and configured to each emit light, wherein the controller is configured to set adjustable options among a plurality of options for each of the plurality of courses, and wherein a respective option adjuster of the plurality of option adjusters is configured to, based on the respective option adjuster corresponding to an adjustable option in a currently displayed course in the course selection screen, emit light to indicate whether the respective option adjuster is adjustable to the user.

18. The laundry treatment apparatus of claim 1, wherein the screen output unit and the option button unit are spaced apart from each other in a width direction of the cabinet.

19. The laundry treatment apparatus of claim 1, further comprising at least one button that is spaced apart from screen output unit and the option button unit in a width direction of the cabinet and that is disposed between the screen output unit and the option button unit in the width direction.

* * * * *